US012097419B2

(12) United States Patent
Lee

(10) Patent No.: US 12,097,419 B2
(45) Date of Patent: Sep. 24, 2024

(54) FRAME SUPPORT MODULE AND BICYCLE SIMULATOR COMPRISING SAME

(71) Applicant: REAL DESIGN TECH CO., LTD., Gyeonggi-do (KR)

(72) Inventor: Joong Sik Lee, Gyeonggi-do (KR)

(73) Assignee: REAL DESIGN TECH CO., LTD., Gyeonggi-Do (KR)

( * ) Notice: Subject to any disclaimer, the term of this patent is extended or adjusted under 35 U.S.C. 154(b) by 351 days.

(21) Appl. No.: 17/429,309

(22) PCT Filed: Feb. 4, 2020

(86) PCT No.: PCT/KR2020/001625
§ 371 (c)(1),
(2) Date: Aug. 6, 2021

(87) PCT Pub. No.: WO2020/162681
PCT Pub. Date: Aug. 13, 2020

(65) Prior Publication Data

US 2022/0105408 A1 Apr. 7, 2022

(30) Foreign Application Priority Data

Feb. 8, 2019 (KR) ..... 10-2019-0015191
Jan. 6, 2020 (KR) ..... 10-2020-0001567

(51) Int. Cl.
*A63B 69/16* (2006.01)
*A63B 22/06* (2006.01)

(52) U.S. Cl.
CPC ..... *A63B 69/16* (2013.01); *A63B 22/0605* (2013.01); *A63B 2069/166* (2013.01)

(58) Field of Classification Search
CPC ..... A63B 2209/00; A63B 2225/09; A63B 2225/093; A63B 69/16–2069/168;
(Continued)

(56) References Cited

U.S. PATENT DOCUMENTS 592,093 A * 10/1897 Law ..... A63B 69/16 482/61
2,803,349 A * 8/1957 Talbot ..... B62H 3/10 24/535

(Continued)

FOREIGN PATENT DOCUMENTS

CN 204684627 U 10/2015
KR 200374313 Y1 1/2005

(Continued)

OTHER PUBLICATIONS

International Search Report and Written Opinion for International Application No. PCT/KR2020/001625, mailed May 12, 2020, 10 pages.

(Continued)

*Primary Examiner* — Loan B Jimenez
*Assistant Examiner* — Catrina A Letterman
(74) *Attorney, Agent, or Firm* — Guntin & Gust, PLC; Miyoung Shin

(57) ABSTRACT

The present invention relates to a bicycle simulator that supports a frame of a mounted bicycle, the frame connecting a front wheel and a rear wheel of the mounted bicycle. A bicycle simulator according to an embodiment includes a base, a first frame support extending in a first direction and supported on the base, and a second frame support extending in a second direction, which is different from the first direction, and connected to the first frame support to be rotatable about one axis, wherein the second frame support supports a frame of a mounted bicycle, the frame connecting a front wheel and a rear wheel of the mounted bicycle.

15 Claims, 30 Drawing Sheets

(58) Field of Classification Search
CPC ..... A63B 22/06–2022/0658; F16M 11/04; F16M 11/06; B62H 3/02; B62H 3/04; B62H 3/06; B62H 3/08; B62H 3/10; B62H 3/12; B62H 2003/005; B62H 5/06; B62H 2700/00; B62H 2700/005
See application file for complete search history.

(56) References Cited

U.S. PATENT DOCUMENTS 2,805,860 A * 9/1957 Littig ..... A63B 69/16 482/61
3,865,244 A * 2/1975 Galen ..... B62H 3/08 211/5
3,879,027 A * 4/1975 Thurmond, Jr. ..... B25H 1/0014 248/167
3,964,611 A * 6/1976 Galen ..... B62H 3/08 211/8
4,958,832 A 9/1990 Kim
5,294,006 A * 3/1994 Deschino ..... A47F 5/0853 211/5
5,642,820 A * 7/1997 Angeles ..... B62H 3/06 211/103
11,008,060 B1 * 5/2021 Liu ..... B62H 3/10
2015/0231780 A1 * 8/2015 Hirokawa ..... B25H 1/0014 248/670
2015/0359114 A1 * 12/2015 Yang ..... F16B 2/12 248/161
2016/0091134 A1 * 3/2016 May ..... G10D 13/02 248/404
2016/0236036 A1 * 8/2016 Kalogiros ..... A63B 22/0023
2018/0274572 A1 9/2018 Wang

FOREIGN PATENT DOCUMENTS

KR 200474864 Y1 10/2014
KR 1020160066031 A 6/2016
KR 101677713 B1 11/2016
KR 101827306 B1 2/2018
WO 2015043656 A1 4/2015

OTHER PUBLICATIONS

Office Action issued in corresponding KR Application No. 102019001519.1, issued Dec. 18, 2019, and an English translation thereof, 11 pages.
Korean Office Action for Counterpart Korean Application No. KR 10-2021-7024944, mailed Jun. 14, 2023 and English translation, 11 pgs.

* cited by examiner

FRAME SUPPORT MODULE AND BICYCLE SIMULATOR COMPRISING SAME

TECHNICAL FIELD

The present invention relates to a frame support module for supporting a bicycle and a bicycle simulator for virtual rides, and more particularly, to a frame support module that supports a bicycle so that a rider virtually experience various travel routes in an indoor space and enjoy exercise effects, and a bicycle simulator including the frame support module.

BACKGROUND ART

In general, bicycle exercise equipment, which is referred to as a bicycle trainer or bicycle roller, is the most widely used indoor exercise fitness equipment along with a treadmill. A rider on a bicycle mounted on a rotating roller or a cradle strengthens his/her lower body strength by pedaling wheels to which rotational resistance (e.g., a magnetic force) is applied.

Such related-art bicycle exercise equipment has an advantage in that a considerably high exercise effect is provided to a rider within only a relatively short time of exercise through the adjustment of rotational resistance applied to wheels regardless of the weather.

However, the related-art bicycle exercise equipment is used to simply continue the pedaling exercise to which the rotational resistance is applied while facing the wall in a closed indoor space. Thus, there is a drawback in that it is difficult to continue the continuous pedaling exercise due to boredom from the inability to provide the rider with the pleasure of actually riding a bicycle.

In order to improve the above problem, Prior Art 1 (Korean Patent No. 10-1677713) and Prior Art 2 (Korean Patent No. 10-1827306) disclose technologies relating to cycle exercise equipment.

In Prior Art 1, by replacing three or more roller portions each rotating about a fixed axis (center axis) and having different outer wall shapes, a rider may be provided with riding experiences under various road conditions similar to when riding a real bicycle, and accordingly, due to the interest induced thereby, the rider may continue the pedaling movement in a continuous manner.

In Prior Art 2, an uneven portion capable of implementing a virtual road surface protrudes along a roller portion, thus providing a safer riding experience and natural change of the road surface to a rider.

However, regarding the cycle exercise equipment disclosed in Prior Art 1 and the bicycle simulator disclosed in Prior Art 2, a frame of a mounted bicycle is bound to a specific support device. However, bicycle frames have recently been designed to have various diameters and shapes according to consumers' needs. Accordingly, when a support device according to the prior art is used, because the support device should be changed according to a type of a mounted bicycle, there is a problem in terms of cost and limitation in the degree of mounting freedom.

DESCRIPTION OF EMBODIMENTS

Technical Problem

The present invention provides a frame support module compatible with bicycle frames implemented in various types, and a bicycle simulator including the frame support module.

Also, the present invention provides a frame support module capable of increasing a support force between a bicycle and a bicycle simulator by increasing a contact area between a bicycle frame and a frame support, and a bicycle simulator including the frame support module.

Also, the present invention provides a frame support module capable of increasing a support force between a bicycle and a bicycle simulator by supporting a bicycle frame at a plurality of support points, and a bicycle simulator including the frame support module.

Solution to Problem

A frame support module according to an embodiment of the present invention includes: a first frame support extending in a first direction; a second frame support extending in the first direction and supported on an end portion of the first frame support; a third frame support supported to be rotatable about one axis with respect to the second frame support; and a fourth frame support spaced apart by a certain interval from the third frame support in the first direction and supported to be rotatable about one axis with respect to the second frame support.

The second frame support may include: a first fixing member extending in the first direction and supporting surfaces of the third frame support and the fourth frame support; and a second fixing member extending in the first direction, facing the first fixing member, and supporting other surfaces of the third frame support and the fourth frame support.

The second fixing member may be located to be rotatable about one axis with respect to the first fixing member.

The third frame support may include: a first soft support member including a first seating portion; and a second soft support member located to be coupled to the first soft support member and including a second seating portion.

The frame support module may further include: a first support case supporting the first soft support member; a second support case supporting the second soft support member; and a first slide guide coupled so that the first support case and the second support case are slidable.

The frame support module may further include a first rotation coupler having one end portion fixed to the second frame support and anther end portion to which the first slide guide is rotatably coupled, wherein the first slide guide rotates about the first rotation coupler with respect to the second frame support.

The fourth frame support may include: a third soft support member including a third seating portion; and a fourth soft support member located to be coupled to the third soft support member and including a fourth seating portion.

The frame support module may further include: a third support case supporting the third soft support member; a fourth support case supporting the fourth soft support member; and a second slide guide coupled so that the third support case and the fourth support case are slidable.

The frame support module may further include a second rotation coupler having an end portion fixed to the second frame support and another end portion to which the second slide guide is rotatably coupled, wherein the second slide guide rotates about the second rotation coupler with respect to the second frame support.

A bicycle simulator according to an embodiment includes: a base; a first frame support extending in a first direction and supported on the base; a second frame support extending in the first direction and supported on an end portion of the first frame support; a third frame support supported to be rotatable about one axis with respect to the second frame support; and a fourth frame support spaced apart by a certain interval from the third frame support in the first direction and supported to be rotatable about one axis with respect to the second frame support, wherein the third frame support supports a lower frame of a mounted bicycle which connects a front wheel and a rear wheel of the mounted bicycle, and the fourth frame support supports an upper frame of the mounted bicycle which connects the front wheel and the rear wheel of the mounted bicycle.

The second frame support may include: a first fixing member extending in the first direction and supporting surfaces of the third frame support and the fourth frame support; and a second fixing member extending in the first direction, facing the first fixing member, and supporting other surfaces of the third frame support and the fourth frame support.

The third frame support may include: a first soft support member including a first seating portion; and a second soft support member located to be coupled to the first soft support member and including a second seating portion, wherein a lower frame of the mounted bicycle is mounted on the first seating portion and the second seating portion.

The bicycle simulator may further include: a first support case supporting the first soft support member; a second support case supporting the second soft support member; and a first slide guide coupled so that the first support case and the second support case are slidable.

The fourth frame support may include: a third soft support member including a third seating portion; and a fourth soft support member located to be coupled to the third soft support member and including a fourth seating portion.

The bicycle simulator may further include: a third support case supporting the third soft support member; a fourth support case supporting the fourth soft support member; and a second slide guide coupled so that the third support case and the fourth support case are slidable.

Advantageous Effects of Disclosure

A frame support module and a bicycle simulator including the same according to an embodiment of the present invention may deform and support a frame support to be compatible with bicycles having different diameters and shapes of bicycle frames according to bicycle types, thereby mounting and using various types of bicycles on a single bicycle simulator.

Also, a frame support module and a bicycle simulator including the same according to an embodiment of the present invention may increase a contact area between a bicycle frame and a frame support and may increase a support force between a bicycle and a bicycle simulator, thereby more stably using the bicycle simulator.

Also, a frame support module and a bicycle simulator including the same according to an embodiment of the present invention may support a bicycle frame at a plurality of support points of the bicycle frame according to a bicycle type, thereby increasing a support force between a bicycle and a bicycle simulator.

MODE OF DISCLOSURE

Figure 1:
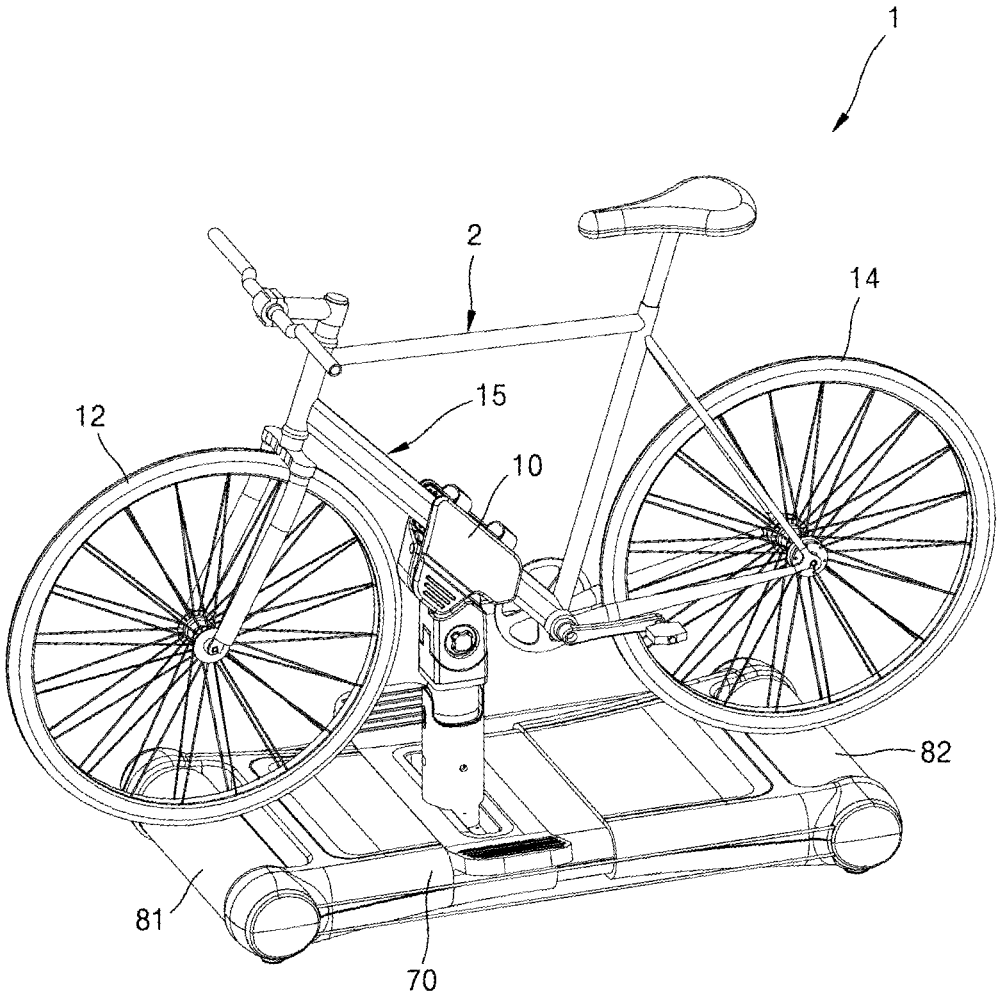
FIG. 1 is a perspective view illustrating a bicycle simulator, according to an embodiment of the present invention.

Hereinafter, the following embodiments will be described with reference to the accompanying drawings, wherein like reference numerals refer to like elements throughout and a repeated description thereof is omitted.

As embodiments allow for various changes, example embodiments will be illustrated in the drawings and described in in detail in the written description. Effects and features of the embodiments, and methods for achieving them will be clarified with reference to details described below in detail with reference to the drawings. However, the embodiments are not limited to the following embodiments and may be embodied in various forms.

While such terms as "first," "second," etc., may be used to describe various components, such components are not be limited to the above terms. The above terms are used only to distinguish one component from another.

In the following embodiments, an expression used in the singular encompasses the expression of the plural, unless it has a clearly different meaning in the context.

In the following embodiments, the up (above), down (below), left and right (lateral), front (forward), rear (back), etc. that indicate directions are not intended to limit the rights, but are determined based on the drawings and a relative position between the components, for convenience of explanation. Thus, each direction described below is based on this, except for a case specifically limited otherwise.

In the following embodiments, it is to be understood that the terms "including," "having," and "comprising" are intended to indicate the existence of features or components described in the specification, and are not intended to preclude the possibility that one or more other features or components may be added.

Sizes of components in the drawings may be exaggerated or contracted for convenience of explanation. For example, because sizes and thicknesses of components in the drawings are arbitrarily illustrated for convenience of explanation, the following embodiments are not limited thereto.

Figure 2A:
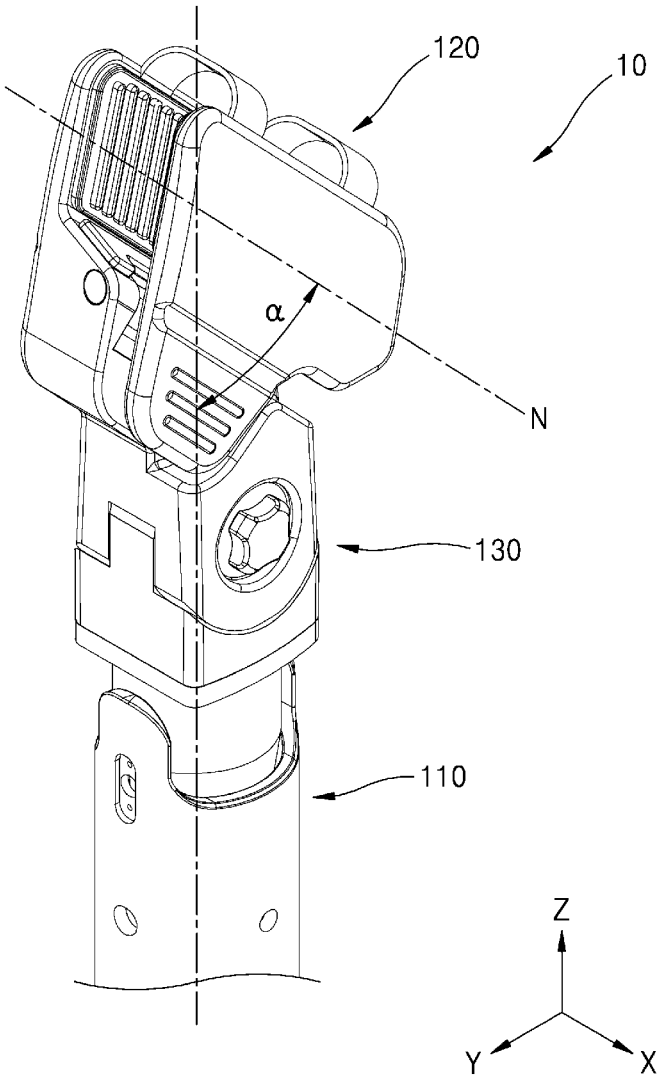
FIG. 2A is a perspective view illustrating a frame support, according to an embodiment of the present invention.
Figure 2B:
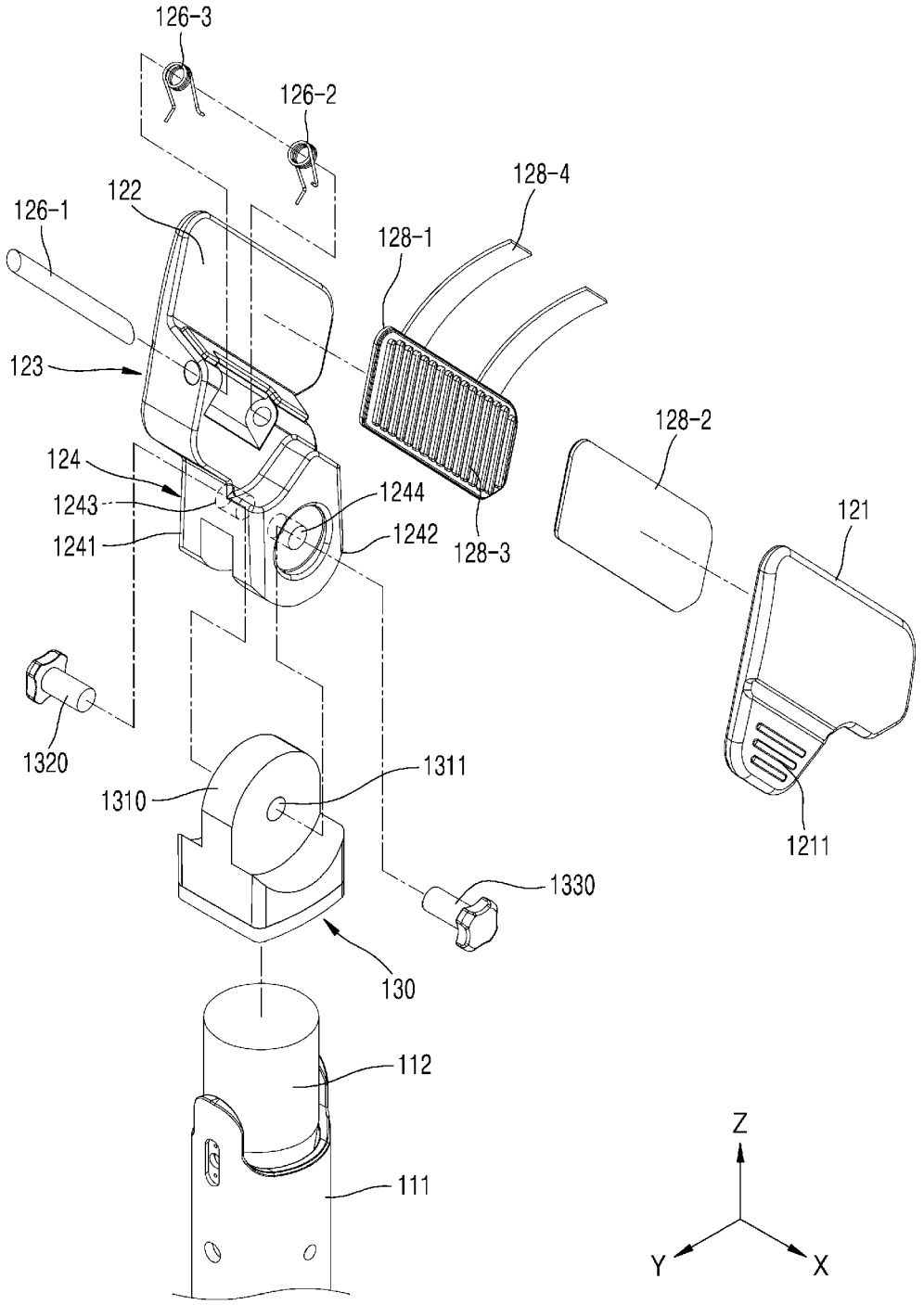
FIG. 2B is an exploded perspective view illustrating the frame support of FIG. 2A.
Figure 3A:
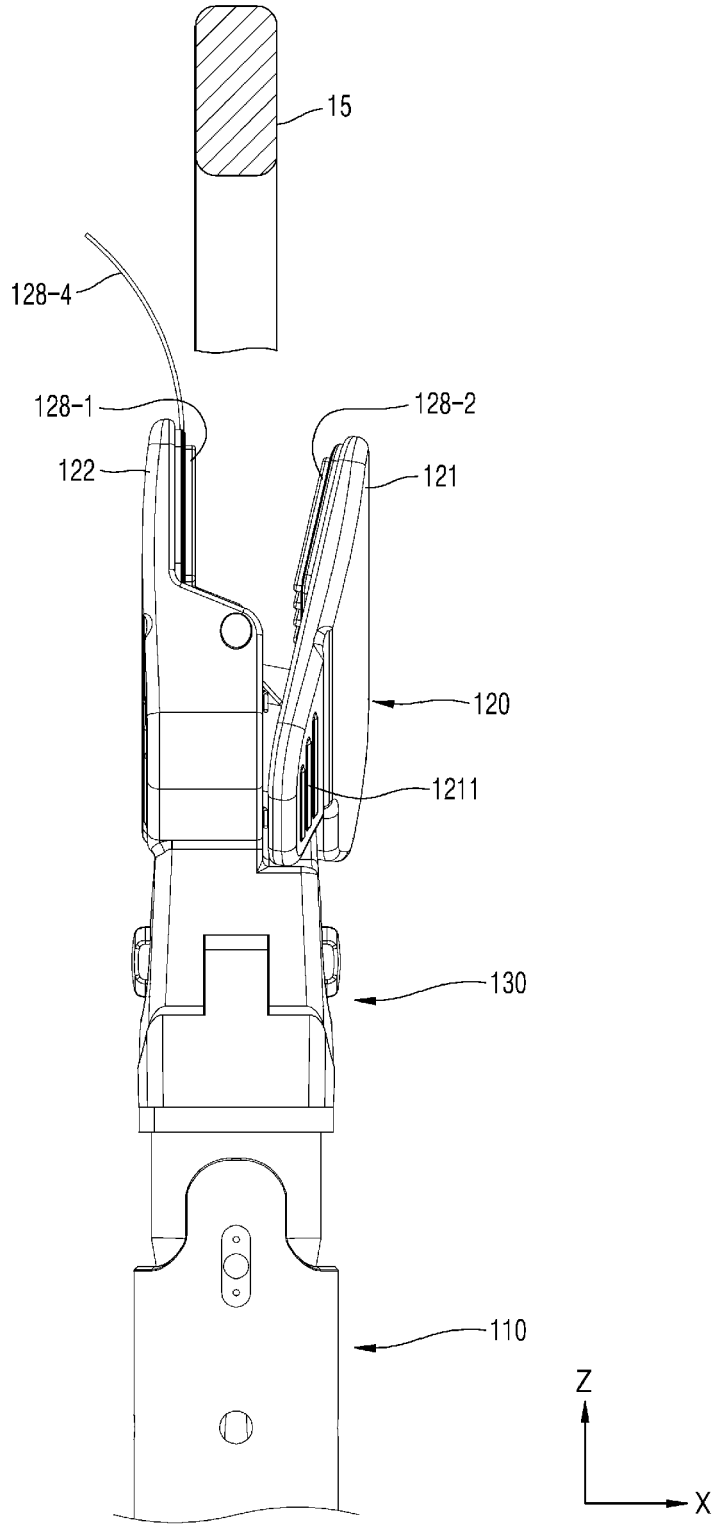
FIGS. 3A and 3B are front views illustrating a frame support, according to an embodiment of the present invention.
Figure 3B:
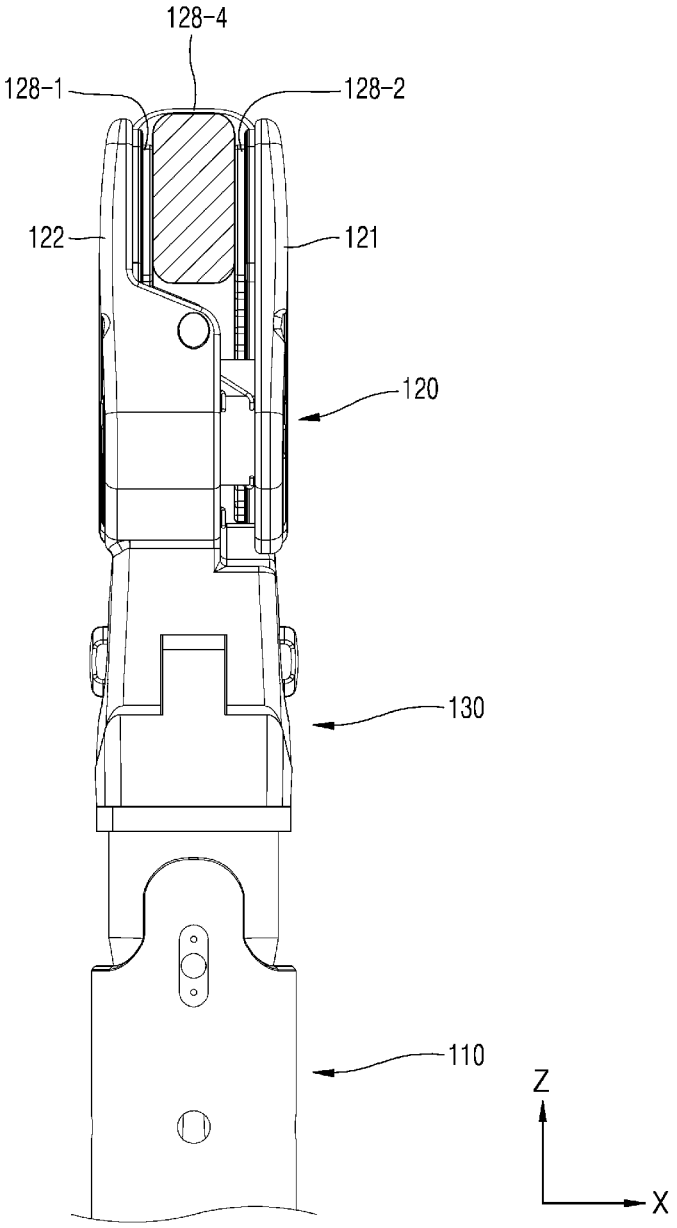
Figure 4:
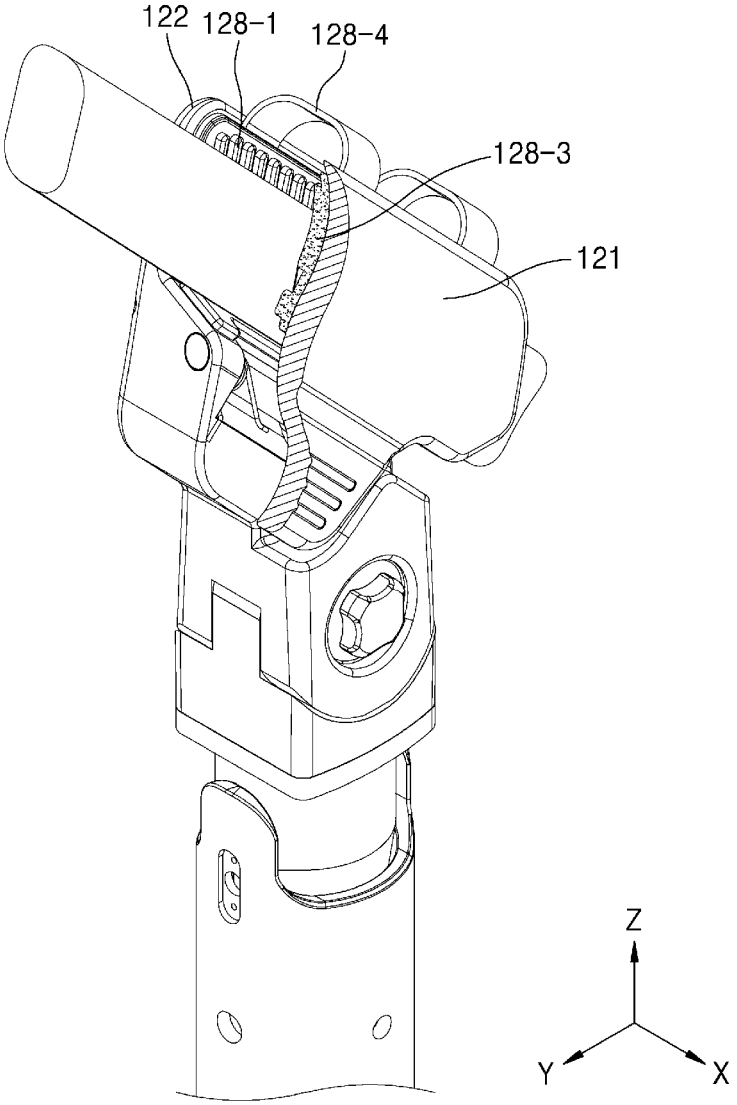
FIG. 4 is a perspective view illustrating a frame support, according to an embodiment of the present invention.

FIG. 1 is a perspective view illustrating a bicycle simulator, according to an embodiment of the present invention. FIG. 2A is a perspective view illustrating a frame support, according to an embodiment of the present invention. FIG. 2B is an exploded perspective view illustrating the frame support of FIG. 2A. FIGS. 3A and 3B are front views illustrating a frame support, according to an embodiment of the present invention. FIG. 4 is a perspective view illustrating a frame support, according to an embodiment of the present invention.

Referring to FIGS. 1 through 2B, in a bicycle simulator 1 according to an embodiment of the present invention, a rider on a bicycle 2 may virtually experience various road surface conditions having a slope, and thus, may enjoy a dynamic and realistic ride. Also, a variety of travel modes, in which a steering range may be adjusted according to a type of the rider is provided, and thus, exercise effects may be naturally maximized according to the type of the rider.

The bicycle 2 mentioned above is not only specially manufactured for only the bicycle simulator 1 according to an embodiment of the present invention, but also is a concept that encompasses all bicycles 2 currently available on the market by various manufacturers. The bicycle 2 may include a bicycle frame 15 constituting the body of the bicycle 2, a front wheel 12 and a rear wheel 14, which are rotatably mounted on the bicycle frame 15, and a drivetrain (e.g., a crank, a chain, and a transmission) that converts pedaling of the rider to a rotational force of the rear wheel 14.

The bicycle simulator 1 according to an embodiment of the present invention may include a frame support module 10, a base 70, a front wheel support 81, and a rear wheel support 82, to implement functions or actions as described above.

The frame support module 10 according to an embodiment of the present invention may include a first frame support 110, a second frame support 120, and a connector 130, as support members that are detachably coupled to the bicycle frame 15 and stably fix a position of the bicycle 2.

The base 70 is a support member that may be fixed to the ground and may support the bicycle 2. For example, the base 70 may have a quadrangular frame shape so that the front wheel support 81 and the rear wheel support 82 described below are mounted on the base 70. However, the present disclosure is not limited thereto, and the base 70 may be provided as any support member on which the front wheel support 81 and the rear wheel support 82 may be mounted. Also, in the base 70 according to an example, a support frame, to which the frame support module 10 may be fixed, may be located across both side portions of the base 70.

The front wheel support 81 is a rod-shaped component that supports the front wheel 12 of the bicycle 2 mounted on the bicycle simulator 1 and rotates together with the front wheel 12, and both end portions of the front wheel support 81 may form a shaft coupling with the base 70 so that the front wheel support 81 freely rotates clockwise or counterclockwise. However, the present disclosure is not limited thereto, and the front wheel support 81 may be rotatably coupled to the base 70 by using a bearing that surrounds the front wheel support 81.

The rear wheel support 82 is a rod-shaped component that supports the rear wheel 14 of the bicycle 2 mounted on the bicycle simulator 1 and rotates together with the rear wheel 14, and both end portions of the rear wheel support 82 may form a shaft coupling with the base 70 so that the rear wheel support 82 freely rotates clockwise or counterclockwise. However, the present disclosure is not limited thereto, and the rear wheel support 82 may be rotatably coupled to the base 70 by using a bearing that surrounds the rear wheel support 82.

The front wheel support 81 and the rear wheel support 82 as described above may have any shapes as long as the front wheel support 81 and the rear wheel support 82 may rotate together with the rotation of the front wheel 12 and the rear wheel 14 while contacting the front wheel 12 and the rear wheel 14. Accordingly, longitudinal sections of the front wheel support 81 and the rear wheel support 82 may each be polygonal, elliptical, or circular. In this case, the front wheel 12 and the rear wheel 14 of the bicycle 2 may respectively freely move on top surfaces of the front wheel support 81 and the rear wheel support 82.

For example, the front wheel support 81 and the rear wheel support 82 according to the present invention may be implemented as rollers having circular longitudinal sections as shown in FIG. 1, so that smooth rotation is possible according to the rotation of the front wheel 12 and the rear wheel 14 without a heterogeneous feeling of ride given to the rider that rotates the front wheel 12 and the rear wheel 14. Also, the rear wheel support 82 according to the present invention may be implemented as two rotating rollers that rotate while supporting the rear wheel 14 back and forth from the bottom of the rear wheel 14 for stable support of the rear wheel 14. The first frame support 110, the second frame support 120, and the connector 130 included in the frame support module 10 will now be described in more detail.

The first frame support 110 according to an embodiment is a support member supported on the base 70. For example, the first frame support 110 may be provided in a rod shape extending in a first direction Z that is perpendicular to the base 70. In this case, in an example, the first frame support 110 may include a first support bar 111 supported to be fixed to the base 70, and a second support bar 112 coupled to rotate about one axis with respect to the first support bar 111. However, the present disclosure is not limited thereto, and the first frame support 110 may be provided in an integrated rod shape extending in the first direction Z.

The second frame support 120 is a support member that supports the bicycle frame 15 of the mounted bicycle. For example, the second frame support 120 may include a first fixing member 121 and a second fixing member 122 that support a surface and another surface of the bicycle frame 15, a bottom surface support 123 that is located between the first fixing member 121 and the second fixing member 122 and supports a bottom surface of the bicycle frame 15, a rotation coupler 124 that is rotatably coupled to the connector 130 described below, a pressing member 126 that applies a pressing force so that the first fixing member 121 and the second fixing member 122 are closer to each other to support the bicycle frame 15, and a first soft pad 128-1 and a second soft pad 128-2.

The first fixing member 121 may be a flat member extending in a second direction N different from the first direction Z in which the first frame support 110 extends, to support a surface of the bicycle frame 15. For example, the second direction N may have a certain angle α with respect to the first direction Z. In this case, the second direction N may be substantially the same as an extension direction of the bicycle frame 15 of the mounted bicycle. For example, the certain angle a may be equal to or greater than 30° and equal to or less than 70°. Also, in an embodiment, the first fixing member 121 may include a rigid member for supporting the bicycle frame 15, for example, a reinforced plastic or metal material.

The second fixing member 122 may be a flat member facing the first fixing member 121 to support another surface of the bicycle frame 15. For example, the second fixing member 122 may extend in the second direction N, like the first fixing member 121. For example, the second fixing member 122 may also include a rigid member for supporting the bicycle frame 15, for example, a reinforced plastic or metal material.

As described above, the bicycle frame 15 may be supported on a wider area by the first fixing member 121 and the second fixing member 122 in an extension direction of the bicycle frame 15. As a support area between the bicycle frame 15 and the first and second fixing members 121 and 122 increases, a support force between the bicycle frame 15 and the second frame support 120 may increase. Accordingly, the second direction N in which the first fixing member 121 and the second fixing member 122 extend may be determined according to a shape, that is, an extension direction, of the bicycle frame 15. Also, an area of the first fixing member 121 and the second fixing member 122 extending in the second direction N may increase or decrease according to a support strength required between the bicycle frame 15 and the first and second fixing members 121 and 122.

The bottom surface support 123 is a support member that may be located between the first fixing member 121 and the second fixing member 122 and may support a bottom surface of the bicycle frame 15. For example, the bottom surface support 123 may be a flat member extending in the second direction N. Although the bottom surface support 123 is integrally formed with the second fixing member 122 in the present embodiment, the bottom surface support 123 may be separated from the second fixing member 122.

The rotation coupler 124 is a connection member that may be rotatably coupled with respect to the connector 130 described below and may rotate the second frame support 120 with respect to the first frame support 110. For example, the rotation coupler 124 may include a first guide 1241 and a second guide 1242 that are spaced apart by a certain interval from each other. The first guide 1241 and the second guide 1242 may be fixed to the bottom surface support 123, and a slide inserter 1310 included in the connector 130 described below may be inserted between the first guide 1241 and the second guide 1242. In this case, insertion holes 1243 and 1244 into which first and second hinge shafts 1320 and 1330 located on both side portions may be inserted may be respectively formed in the first guide 1241 and the second guide 1242.

The pressing member 126 may apply a pressing force so that the first fixing member 121 and the second fixing member 122 are closer to each other. For example, the pressing member 126 may include a connection shaft 126-1 located between the first fixing member 121 and the second fixing member 122, and a first elastic portion 126-2 and a second elastic portion 126-3 located on both end portions of the connection shaft 126-1. The connection shaft 126-1 according to an example may be fixed to the second fixing member 122, and may be rotatably located on the first fixing member 121. In this case, for example, the first elastic portion 126-2 and the second elastic portion 126-3 may be torsion springs, and both end portions of the first elastic portion 126-2 and the second elastic portion 126-3 may be respectively supported on the first fixing member 121 and the second fixing member 122. Due to the first elastic portion 126-2 and the second elastic portion 126-3, the first fixing member 121 and the second fixing member 122 may receive a pressing force to be closer to each other. Accordingly, the bicycle frame 15 located between the first fixing member 121 and the second fixing member 122 may be supported by the first fixing member 121 and the second fixing member 122 as shown in FIG. 3B. In order to detach the bicycle frame 15, a user may separate the first fixing member 121 from the second fixing member 122 by applying a pressing force to an opening pad 1211 fixed to the first fixing member 121 as shown in FIG. 3A. Although a pressing member using a torsion spring is described in the above embodiment, the present invention is not limited thereto, and another pressing member capable of applying a pressing force to the bicycle frame 15 located between the first fixing member 121 and the second fixing member 122 may be located.

The first soft pad 128-1 and the second soft pad 128-2 may be respectively fixed to the first fixing member 121 and the second fixing member 122 to increase a contact area with the bicycle frame 15. The first soft pad 128-1 and the second soft pad 128-2 according to an example may include a silicone or rubber material that is easily deformed. Also, a plurality of protrusions 128-3 may be located on surfaces of the first soft pad 128-1 and the second soft pad 128-2. As shown in FIG. 4, the plurality of protrusions 128-3 may contact the bicycle frame 15, and thus may prevent sliding from occurring while the first soft pad 128-1 and the second soft pad 128-2 contact the bicycle frame 15. Also, according to an example, a detachable connection pad 128-4 may be located between the first soft pad 128-1 and the second soft pad 128-2. In an embodiment, the connection pad 128-4 may prevent the bicycle frame 15 from being detached upward from the first soft pad 128-1 and the second soft pad 128-2 as shown in FIG. 3B. Also, in order to mount the bicycle frame 15, the connection pad 128-4 may be separated from the first fixing member 121 as shown in FIG. 3A, to secure an insertion path of the bicycle frame 15.

The connector 130 is a connection member for connecting the second frame support 120 to the first frame support 110. In an embodiment, the connector 130 may be detachably located on an end portion of the first frame support 110. Also, in an embodiment, the connector 130 may be integrally formed with the second frame support 120, and thus the second frame support 120 may be detachably located on the first frame support 110. Accordingly, the user may locate the second frame support 120 corresponding to the bicycle frame 15 of the mounted bicycle 2 to be replaceably attached to the first frame support 110.

Also, the connector 130 may include the slide inserter 1310 having a hinge hole 1311, the first hinge shaft 1320, and the second hinge shaft 1330. The slide inserter 1310 according to an example may be rotatably inserted between the first guide 1241 and the second guide 1242 included in the second frame support 120. In this case, the first hinge shaft 1320 and the second hinge shaft 1330 may be inserted into the hinge hole 1311 and the insertion holes 1243 and 1244 and may be used as rotation shafts. Accordingly, the second frame support 120 may rotate about the first and second hinge shafts 1320 and 1330 with respect to the first frame support 110. According to an example, when adjustment of a rotation angle of the second frame support 120 with respect to the first frame support 110 is completed, the bicycle frame 15 may be stably supported by fixing a relative position of the second frame support 120 to the first frame support 110. A more detailed process of adjusting a rotation angle of the second frame support 120 according to a shape of the bicycle frame 15 will be described with reference to FIGS. 5A and 5B.

Figure 5A:
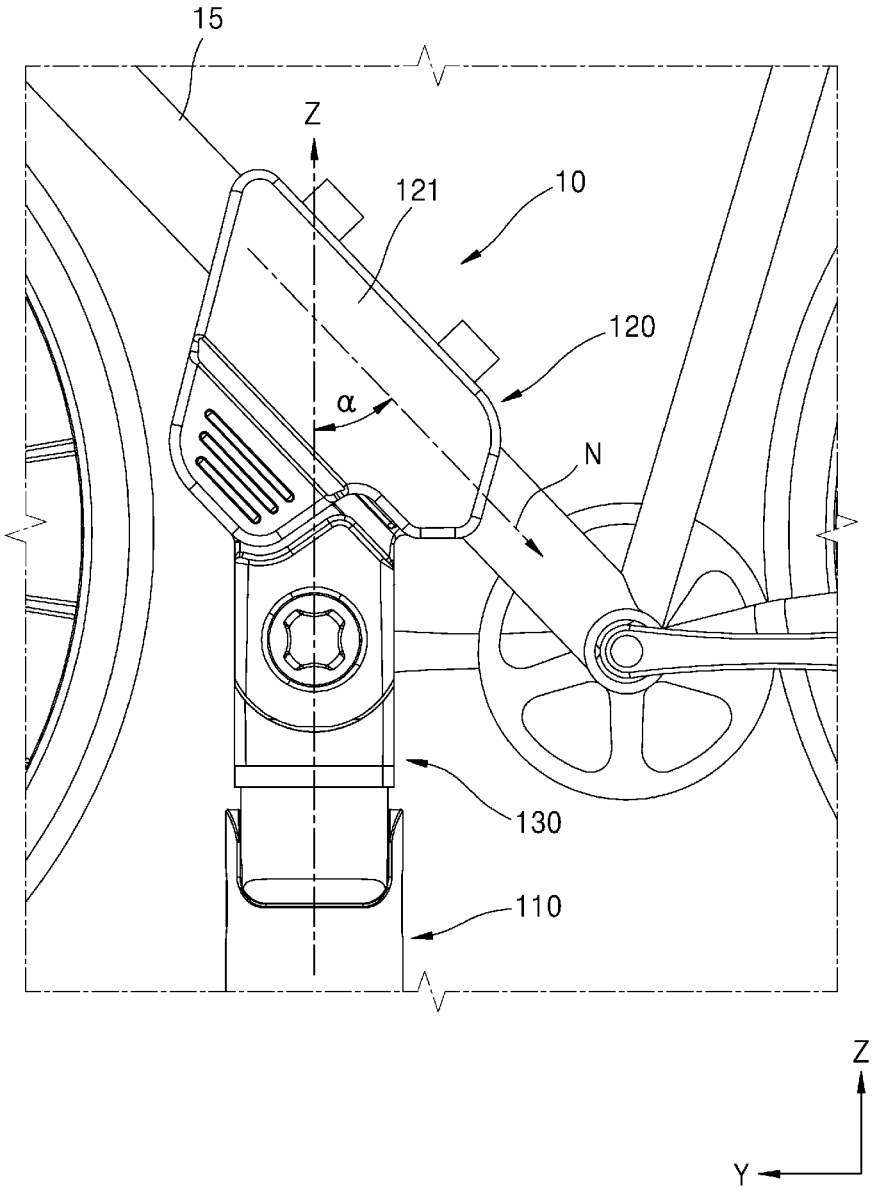
FIGS. 5A and 5B are perspective views illustrating a frame support, according to an embodiment of the present invention.
Figure 5B:
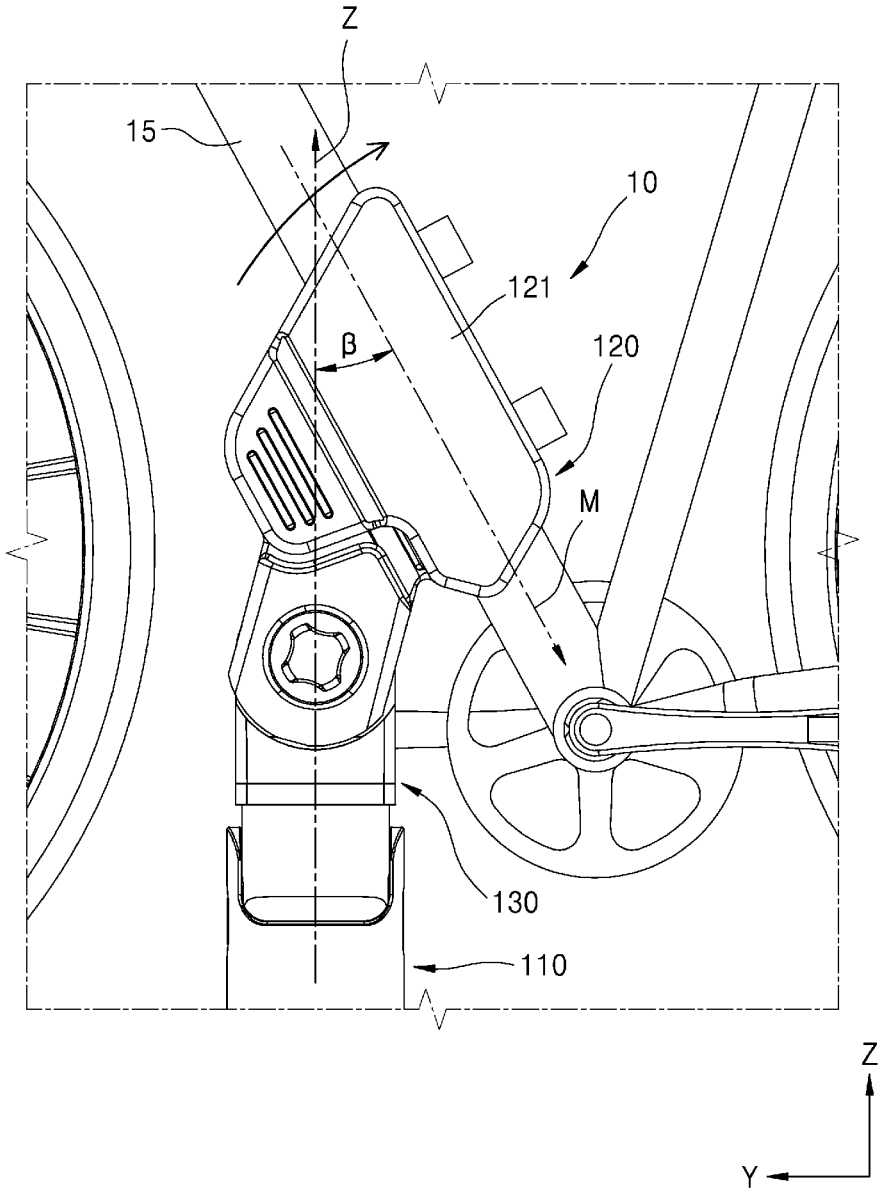
Figure 6:
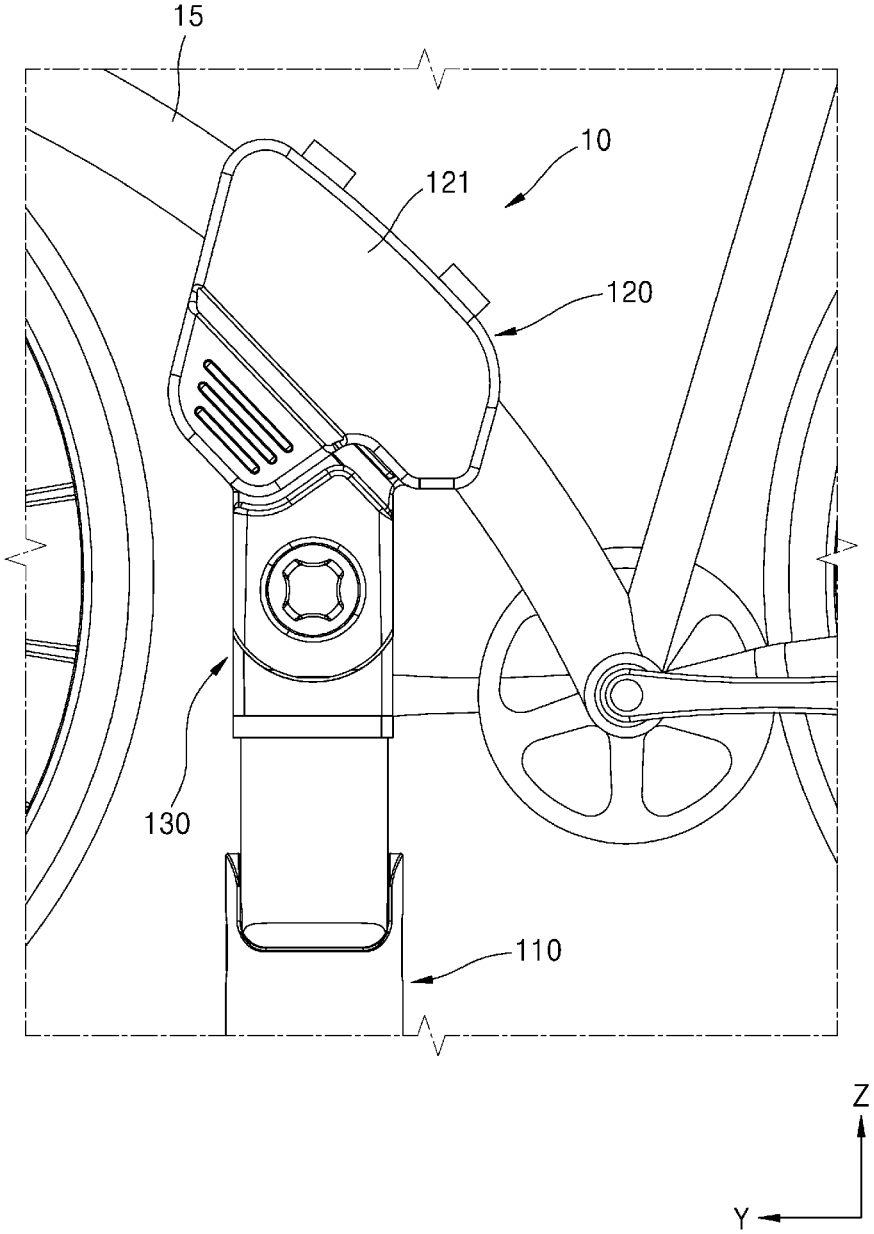
FIG. 6 is a perspective view illustrating a frame support, according to another embodiment of the present invention.

FIGS. 5A and 5B are perspective views illustrating a frame support, according to an embodiment of the present invention. FIG. 6 is a perspective view illustrating a frame support, according to another embodiment of the present invention.

Referring to FIG. 5A, the frame support module 10 according to an embodiment may include the second frame support 120 including the first fixing member 121 and the second fixing member 122 extending in the same direction as the bicycle frame 15 extending in the second direction N. Accordingly, a support area between the bicycle frame 15 and the first and second fixing members 121 and 122 may be maximized, and a support force between the bicycle frame 15 and the second frame support 120 may increase. However, an extension direction of the bicycle frame 15 may vary according to a model of a bicycle. For example, when the bicycle frame 15 extends in a third direction M different from the second direction N as shown in FIG. 5B, a support area between the second frame support 120 and the bicycle frame 15 illustrated in FIG. 5A may decrease.

Referring to FIG. 5B, the second frame support 120 according to an embodiment may be connected to rotate clockwise or counterclockwise about the first and second hinge shafts 1320 and 1330 with respect to the first frame support 110, to be compatible with various bicycle frames 15. For example, when the bicycle frame 15 extends in the third direction M rotated by a certain angle β clockwise compared to the second direction N, the second frame support 120 may rotate by a certain angle clockwise about the first and second hinge shafts 1320 and 1330 with respect to the first frame support 110. In this case, for example, a rotation angle of the second frame support 120 may be equal to or greater than 0° and equal to or less than 60°. Also, a rotation path of the second frame support 120 may be set to gradually increase a rotation angle or to increase stepwise by a certain angle. When rotation is completed, the user may fix a relative position of the second frame support 120 to the first frame support 110. As described above, as the second frame support 120 rotates in an extension direction of the bicycle frame 15, a support area between the bicycle frame 15 and the first and second fixing members 121 and 122 may be maintained, and a support force between the bicycle frame 15 and the second frame support 120 may also be maintained.

Recently, the bicycle frame 15 may be implemented to have a linear shape or a curved shape according to a model of the bicycle. According to an example, when the bicycle frame 15 is implemented to have any one of a curved shape and a linear shape, the first fixing member 121 and the second fixing member 122 may also extend in any one of a curved direction or a linear direction to correspond to the shape of the bicycle frame 15. For example, when the bicycle frame 15 is implemented to have a curved shape as shown in FIG. 6, the first fixing member 121 and the second fixing member 122 may also extend in a curved direction to correspond to the bicycle frame 15. Accordingly, a support area between the bicycle frame 15 and the first and second fixing members 121 and 122 may be maintained, and a support force between the bicycle frame 15 and the second frame support 120 may also be maintained.

Figure 7:
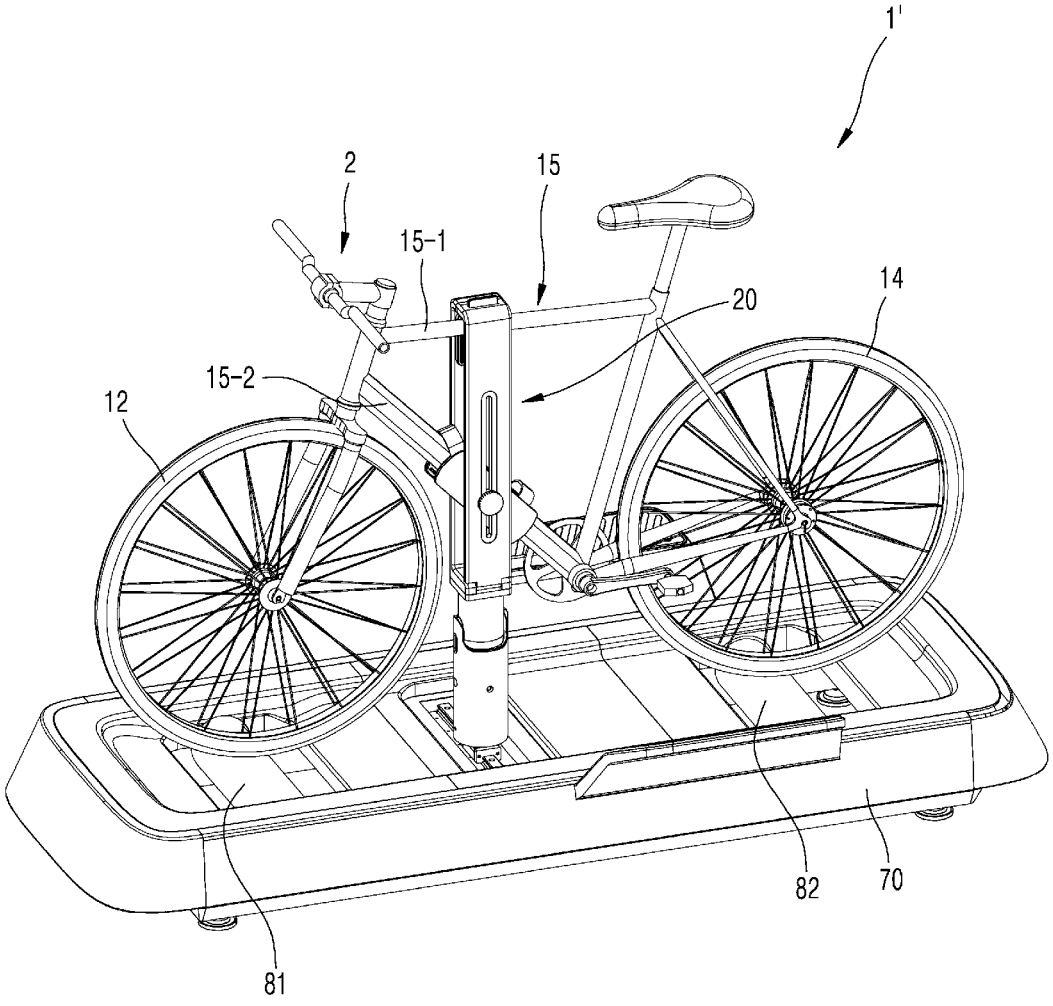
FIG. 7 is a perspective view illustrating a bicycle simulator, according to another embodiment of the present invention.
Figure 8:
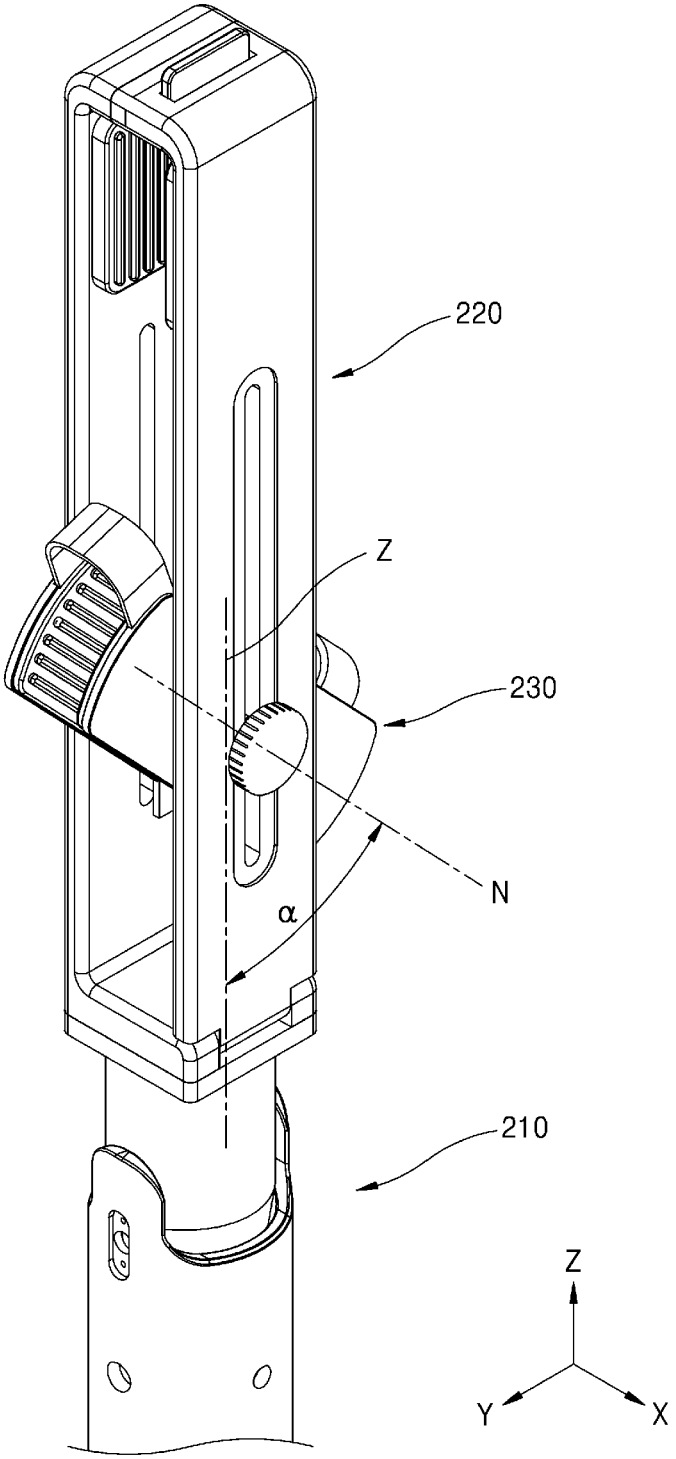
FIG. 8 is a perspective view illustrating a frame support, according to another embodiment of the present invention
Figure 9:
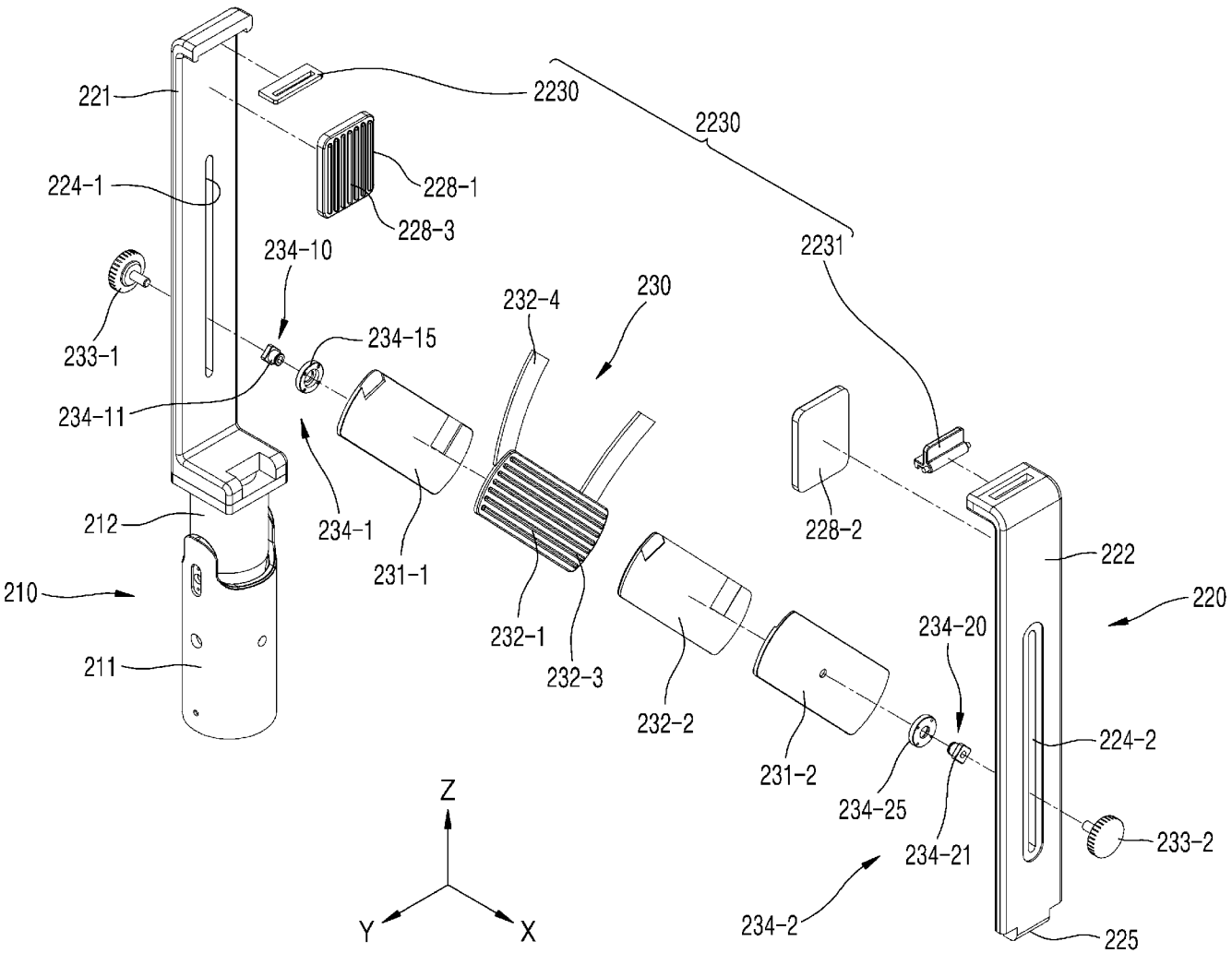
FIG. 9 is an exploded perspective view illustrating the frame support of FIG. 8.
Figure 10A:
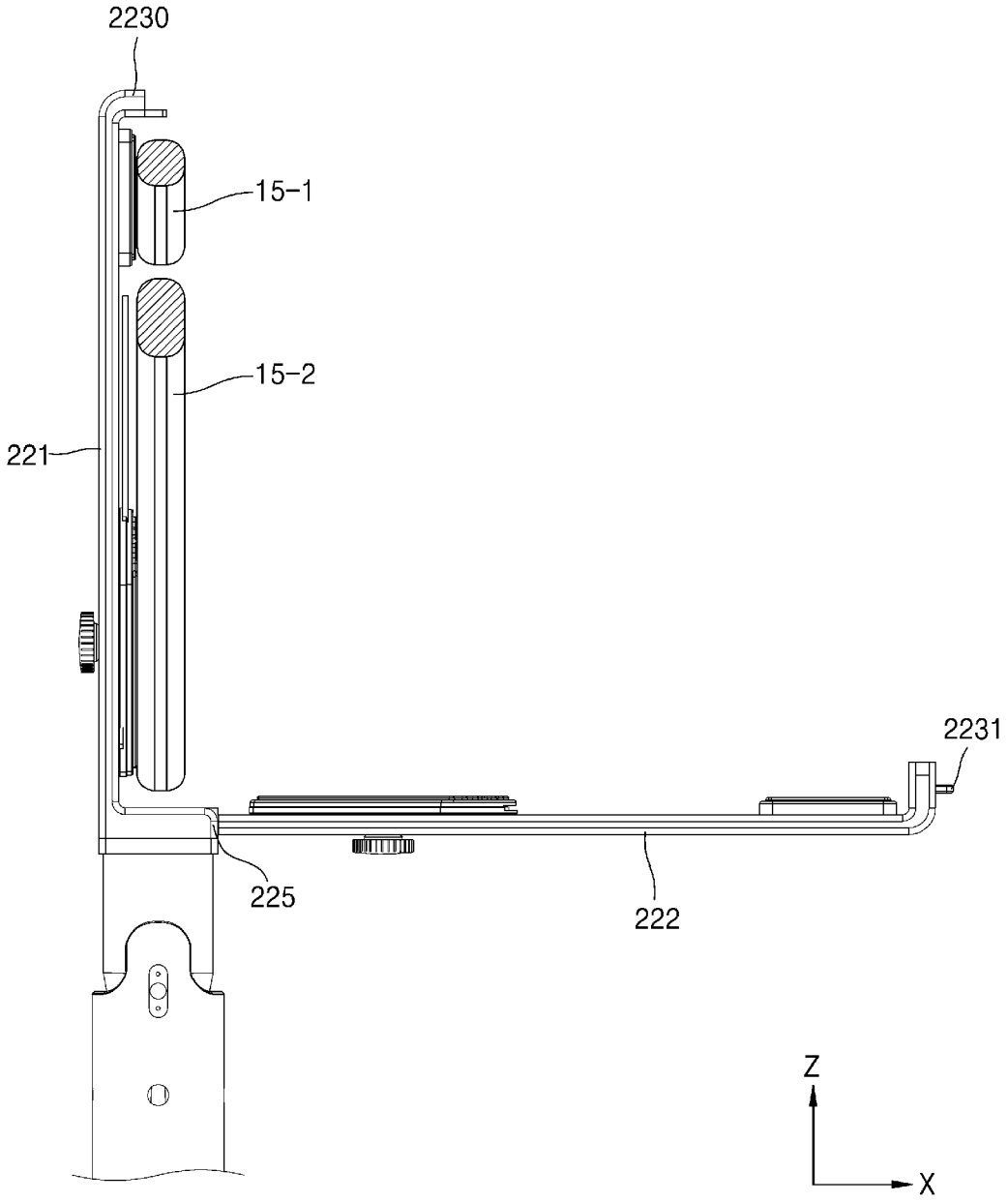
FIGS. 10A and 10B are front views illustrating a frame support, according to another embodiment of the present invention.
Figure 10B:
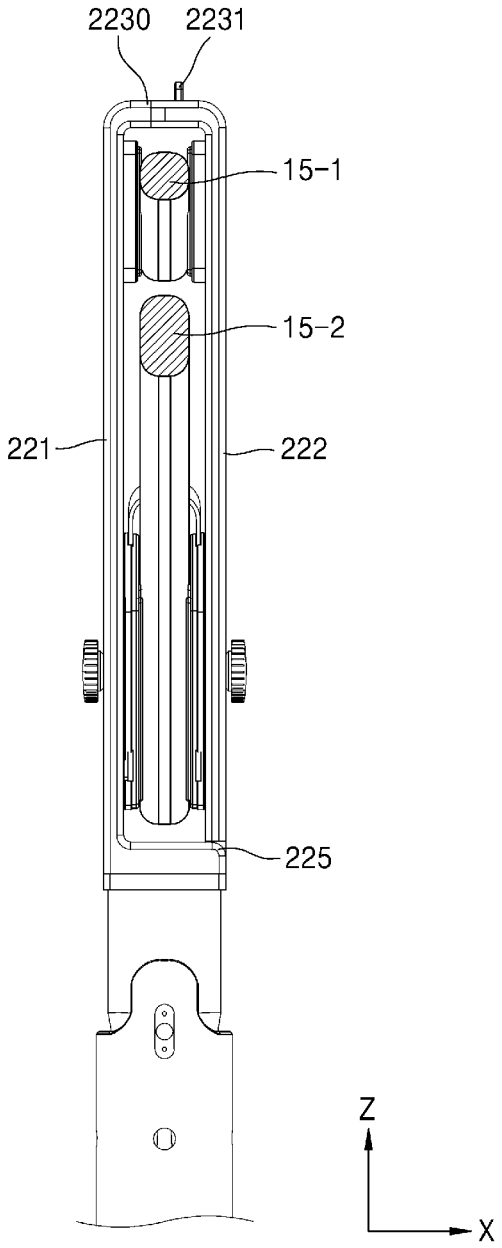
Figure 11A:
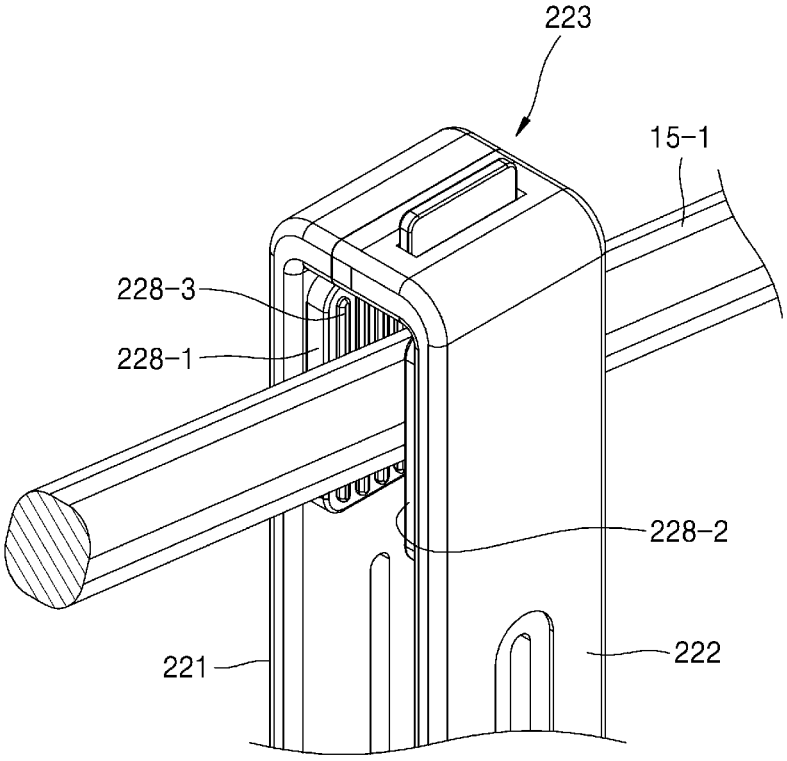
FIGS. 11A and 11B are partial perspective views illustrating a frame support, according to another embodiment of the present invention.
Figure 11B:
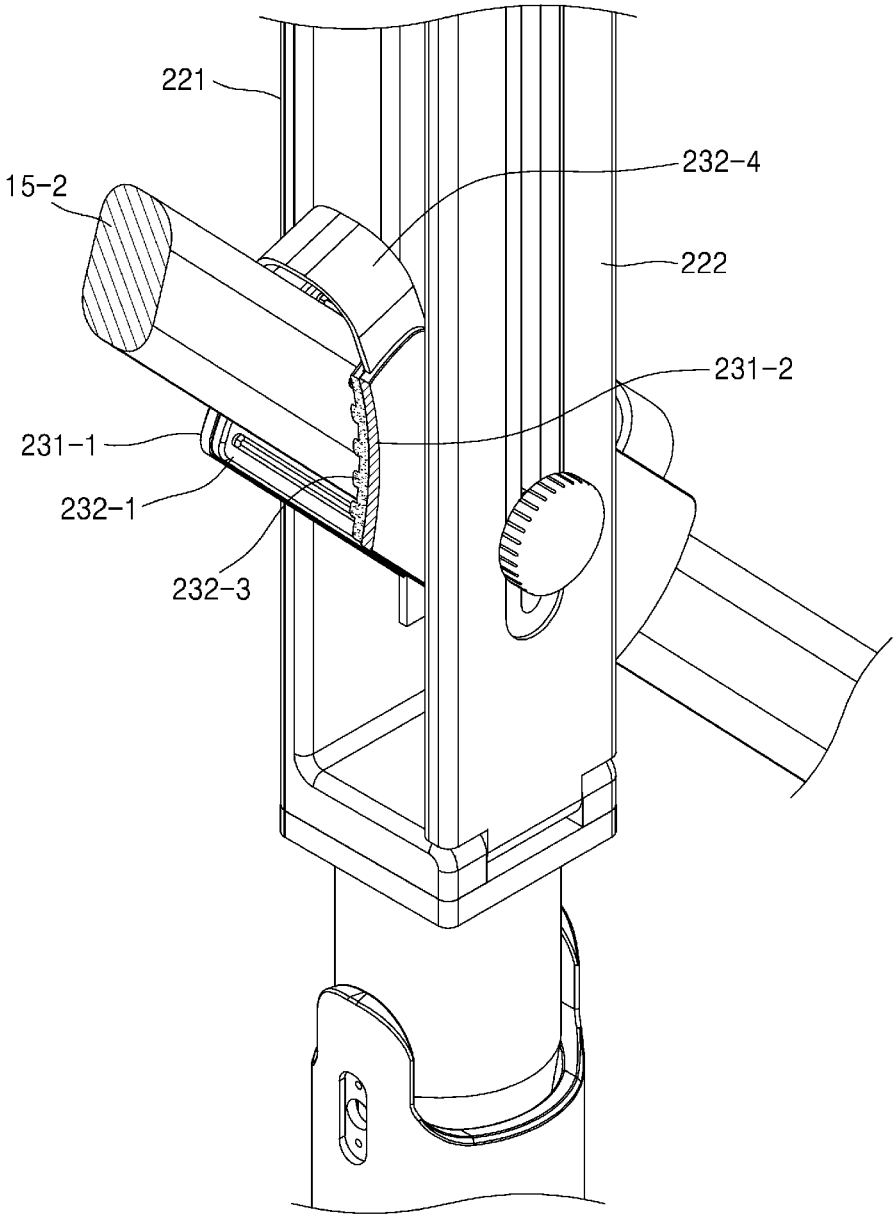

FIG. 7 is a perspective view illustrating a bicycle simulator, according to another embodiment of the present invention. FIG. 8 is a perspective view illustrating a frame support, according to another embodiment of the present invention. FIG. 9 is an exploded perspective view illustrating the frame support of FIG. 8. FIGS. 10A and 10B are front views illustrating a frame support, according to another embodiment of the present invention. FIGS. 11A and 11B are partial perspective views illustrating a frame support, according to another embodiment of the present invention.

Referring to FIGS. 7 through 9, a bicycle simulator 1' according to another embodiment of the present invention may include a frame support module 20, the base 70, the front wheel support 81, and the rear wheel support 82, to implement functions or actions as described above. The base 70, the front wheel support 81, and the rear wheel support 82 according to another embodiment of the present invention are substantially the same as those illustrated in FIGS. 1 through 2B, and thus for convenience of explanation, a repeated description will be omitted.

The frame support module 20 according to another embodiment of the present invention may include a first frame support 210, a second frame support 220, and a third frame support 230, as support members that are detachably coupled to the bicycle frame 15 and stably fix a position of the bicycle 2. The bicycle 2 mounted on the bicycle simulator 1' according to another embodiment of the present invention may include an upper frame 15-1 and a lower frame 15-2 that connect the front wheel 12 to the rear wheel 14.

The first frame support 210 according to an embodiment is a support member supported on the base 70. For example, the first frame support 210 may be provided in a rod shape extending in the first direction Z that is perpendicular to the base 70. In this case, in an embodiment, the first frame support 210 may include a first support bar 211 supported to be fixed to the base 70, and a second support bar 212 coupled to rotate about one axis with respect to the first support bar 211. However, the present disclosure is not limited thereto, and the first frame support 210 may be provided in an integrated rod shape extending in the first direction Z.

The second frame support 220 is a support member that is supported on an end portion of the first frame support 210 and supports the upper frame 15-1 and the lower frame 15-2 of a mounted bicycle. Hereinafter, the term. "1-1$^{th}$ " correspond to first and the term, "1-2$^{th}$ " corresponds to second. By way of example, a 1-1$^{th}$ fixing member corresponds to a first fixing member and a 1-2$^{th}$ fixing member corresponds to a second fixing member. As another example, a 1-1$^{th}$ soft pad and a 1-2$^{th}$ soft pad correspond to a first soft pad and a second soft pad. respectively. For example, the second frame support 220 may include a 1-1$^{th}$fixing member 221 and a 1-2$^{th}$ fixing member 222 that support surfaces and other surfaces of the upper frame 15-1 and the lower frame 15-2, and a 1-1$^{th}$ soft pad 228-1 and a 1-2$^{th}$ soft pad 228-2.

The 1-1$^{th}$ fixing member 221 may be a flat member extending in the first direction Z in which the first frame support 210 extends, to support surfaces of the upper frame 15-1 and the lower frame 15-2. Also, in an embodiment, the 1-1$^{th}$ fixing member 221 may include a rigid member for supporting the upper frame 15-1 and the lower frame 15-2, for example, a reinforced plastic or metal material.

The 1-2$^{th}$ fixing member 222 may be a flat member facing the 1-1$^{th}$ fixing member 121 to support other surfaces of the upper frame 15-1 and the lower frame 15-2. For example, the 1-2$^{th}$ fixing member 222 may extend in the first direction Z, like the 1-1$^{th}$ fixing member 221. For example, the 1-2$^{th}$ fixing member 222 may also include a rigid member for supporting the upper frame 15-1 and the lower frame 15-2, for example, a reinforced plastic or metal material.

A hinge 225 may be located on end portions of the 1-1$^{th}$ fixing member 221 and the 1-2$^{th}$ fixing member 222, so that the 1-2$^{th}$ fixing member 222 rotates with respect to the 1-1$^{th}$ fixing member 221. For example, when the upper frame 15-1 and the lower frame 15-2 are to be located between the 1-1$^{th}$ fixing member 221 and the 1-2$^{th}$ fixing member 222, as shown in FIG. 10A, the 1-2$^{th}$ fixing member 222 may be opened by rotating clockwise about one axis X with respect to the 1-1$^{th}$ fixing member 221. Accordingly, the user may locate the upper frame 15-1 and the lower frame 15-2 between the 1-1$^{th}$ fixing member 221 and the 1-2$^{th}$ fixing member 222. When arrangement of the upper frame 15-1 and the lower frame 15-2 between the 1-1$^{th}$ fixing member 221 and the 1-2$^{th}$ fixing member 222 is completed, as shown in FIG. 10B, the 1-2$^{th}$ fixing member 222 may be closed by rotating counterclockwise about one axis X so that other end portions of the 1-1$^{th}$ fixing member 221 and the 1-2$^{th}$ fixing member 222 contact each other. In this case, the other end portions of the 1-1$^{th}$ fixing member 221 and the 1-2$^{th}$ fixing member 222 may be fastened to each other by using a fastener 223 located on the other end portions of the 1-1$^{th}$ fixing member 221 and the 1-2$^{th}$ fixing member 222, for example, a first fastener 2230 and a second fastener 2231 that may be coupled to each other. Accordingly, relative positions of the 1-1$^{th}$ fixing member 221 and the 1-2$^{th}$ fixing member 222 may be fixed, and the upper frame 15-1 and the lower frame 15-2 may be supported between the 1-1$^{th}$ fixing member 221 and the 1-2$^{th}$ fixing member 222.

The 1-1$^{th}$ soft pad 228-1 and the 1-2$^{th}$ soft pad 228-2 may be respectively fixed to the 1-1$^{th}$ fixing member 221 and the 1-2$^{th}$ fixing member 222 to increase a contact area with the upper frame 15-1. The 1-1$^{th}$ soft pad 228-1 and the 1-2$^{th}$ soft pad 228-2 according to an example may include a silicone or rubber material that is easily deformed. Also, a plurality of protrusions 228-3 may be located on surfaces of the 1-1$^{th}$ soft pad 228-1 and the 1-2$^{th}$ soft pad 228-2. As shown in FIG. 11A, the plurality of protrusions 228-3 may contact the upper frame 15-1, and thus may prevent sliding from occurring while the 1-1$^{th}$ soft pad 228-1 and the 1-2$^{th}$ soft pad 228-2 contact the upper frame 15-1.

The third frame support 230 is a support member that supports the lower frame 15-2 of the mounted bicycle. For example, the third frame support 230 may include a 2-1$^{th}$ fixing member 231-1 and a 2-2$^{th}$ fixing member 231-2 that support a surface and another surface of the lower frame 15-2, a 2-1$^{th}$ soft pad 232-1 and a 2-2$^{th}$ soft pad 232-2, sliders 233-1 and 233-2 that guide movement paths of the 2-1$^{th}$ fixing member 231-1 and the 2-2$^{th}$ fixing member 231-2 with respect to the second frame support 220, and rotation couplers 234-1 and 234-2 that rotate the 2-1$^{th}$ fixing member 231-1 and the 2-2$^{th}$ fixing member 231-2 with respect to the second frame support 220.

The 2-1$^{th}$ fixing member 231-1 may be a flat member extending in the second direction N different from the first direction Z in which the second frame support 220 extends, to support a surface of the lower frame 15-2. For example, the second direction N may have a certain angle a with respect to the first direction Z. In this case, the second direction N may be set to be substantially the same as an extension direction of the bicycle frame 15 of the mounted bicycle. For example, the certain angle a may be equal to or greater than 30° and equal to or less than 70°. Also, in an embodiment, the 2-1$^{th}$ fixing member 231-1 may include a rigid member for supporting the lower frame 15-2, for example, a reinforced plastic or metal material.

The 2-2$^{th}$ fixing member 231-2 may be a flat member facing the 2-1$^{th}$ fixing member 231-1 to support another surface of the lower frame 15-2. For example, the 2-2$^{th}$ fixing member 231-2 may extend in the second direction N, like the 2-1$^{th}$ fixing member 231-1. For example, the 2-2$^{th}$ fixing member 231-2 may also include a rigid member for supporting the lower frame 15-2, for example, a reinforced plastic or metal material.

As described above, the lower frame 15-2 may be supported on a wider area by the 2-1$^{th}$ fixing member 231-1 and the 2-2$^{th}$ fixing member 231-2 in an extension direction of the lower frame 15-2. As a support area between the lower frame 15-2 and the 2-1$^{th}$ and 2-2$^{th}$ fixing members 231-1 and 231-2 increases, a support force between the lower frame 15-2 and the third frame support 230 may increase. Accordingly, the second direction N in which the 2-1$^{th}$ fixing member 231-1 and the 2-2$^{th}$ fixing member 231-2 extend may be determined according to a shape, that is, an extension direction, of the lower frame 15-2. Also, an area of the 2-1$^{th}$ fixing member 231-1 and the 2-2$^{th}$ fixing member 231-2 extending in the second direction N may be determined according to a support strength required between the lower frame 15-2 and the 2-1$^{th}$ and 2-2$^{th}$ fixing members 231-1 and 231-2.

The 2-1$^{th}$ soft pad 232-1 and the 2-2$^{th}$ soft pad 232-2 may be respectively fixed to the 2-1$^{th}$ fixing member 231-1 and the 2-2$^{th}$ fixing member 231-2 to increase a contact area with the lower frame 15-2. The 2-1$^{th}$ soft pad 232-1 and the 2-2$^{th}$ soft pad 232-2 according to an example may include a silicone or rubber material that is easily deformed. Also, a plurality of protrusions 232-3 may be located on surfaces of the 2-1$^{th}$ soft pad 232-1 and the 2-2$^{th}$ soft pad 232-2. As shown in FIG. 11B, the plurality of protrusions 232-3 may contact the lower frame 15-2, and thus may prevent sliding from occurring while the 2-1$^{th}$ soft pad 232-1 and the 2-2$^{th}$ soft pad 232-2 contact the lower frame 15-2. Also, according to an example, a detachable connection pad 232-4 may be located between the 2-1$^{th}$ soft pad 232-1 and the 2-2$^{th}$ soft pad 232-2. In an embodiment, the connection pad 232-4 may prevent the lower frame 15-2 from being detached upward from the 2-1$^{th}$ soft pad 232-1 and the 2-2$^{th}$ soft pad 232-2 as shown in FIG. 11B. Also, in order to insert the lower frame 15-2, the connection pad 232-4 may be separated from the 2-1$^{th}$ soft pad 232-1, to secure an insertion path of the lower frame 15-2.

The sliders 233-1 and 233-2 are guide members that guide movement paths of the 2-1$^{th}$ fixing member 231-1 and the 2-2$^{th}$ fixing member 231-2 in the first direction Z. For example, slide guides 224-1 and 224-2 extending in the first direction Z may be respectively formed in the 1-1$^{th}$ fixing member 221 and the 1-2$^{th}$ fixing member 222. In this case, the sliders 233-1 and 233-2 may be respectively inserted into the slide guides 224-1 and 224-2, and end portions of the sliders 233-1 and 233-2 may be supported in the first direction Z with respect to the 2-1$^{th}$ fixing member 231-1 and the 2-2$^{th}$ fixing member 231-2. Accordingly, when the sliders 233-1 and 233-2 move in the first direction Z, the 2-1$^{th}$ fixing member 231-1 and the 2-2$^{th}$ fixing member 231-2 may also move in the first direction Z. Accordingly, positions of the 2-1$^{th}$ fixing member 231-1 and the 2-2$^{th}$ fixing member 231-2 may be adjusted in the first direction Z, to be compatible with the lower frames 15-2 of bicycles having different heights in the first direction Z.

The rotation couplers 234-1 and 234-2 are connection members that rotatably connect the 2-1$^{th}$ fixing member 231-1 and the 2-2$^{th}$ fixing member 231-2 with respect to the second frame support 220. For example, the rotation couplers 234-1 and 234-2 may include intermediate couplers 234-10 and 234-20 having end portions into and on which the sliders 233-1 and 233-2 are inserted and supported, and bearings 234-15 and 234-25 on which the intermediate couplers 234-10 and 234-20 are rotatably supported and that are fixed to the 2-1$^{th}$ fixing member 231-1 and the 2-2$^{th}$ fixing member 231-2. For example, the intermediate couplers 234-10 and 234-20 may be inserted into the bearings 234-15 and 234-25, and may include rotation shafts 234-11 and 234-21 into which the sliders 233-1 and 233-2 are inserted. In this case, the 2-1$^{th}$ fixing member 231-1 and the 2-2$^{th}$ fixing member 231-2 supported on the bearings 234-15 and 234-25 may respectively rotate about the rotation shafts 234-11 and 234-21. According to an embodiment, when adjustment of angles of the 2-1$^{th}$ fixing member 231-1 and the 2-2$^{th}$ fixing member 231-2 with respect to the lower frame 15-2 is completed, relative positions of the 2-1$^{th}$ fixing member 231-1 and the 2-2$^{th}$ fixing member 231-2 with respect to the second frame support 220 may be restricted by applying a pressure from both side portions of the 1-1$^{th}$ fixing member 221 and the 1-2$^{th}$ fixing member 222 by using the fastener 223 that may fasten other end portions of the 1-1$^{th}$ fixing member 221 and the 1-2$^{th}$ fixing member 222. A more detailed process of adjusting a rotation angle of the third frame support 230 according to a shape of the lower frame 15-2 will be described with reference to FIGS. 12A and 12B.

Figure 12A:
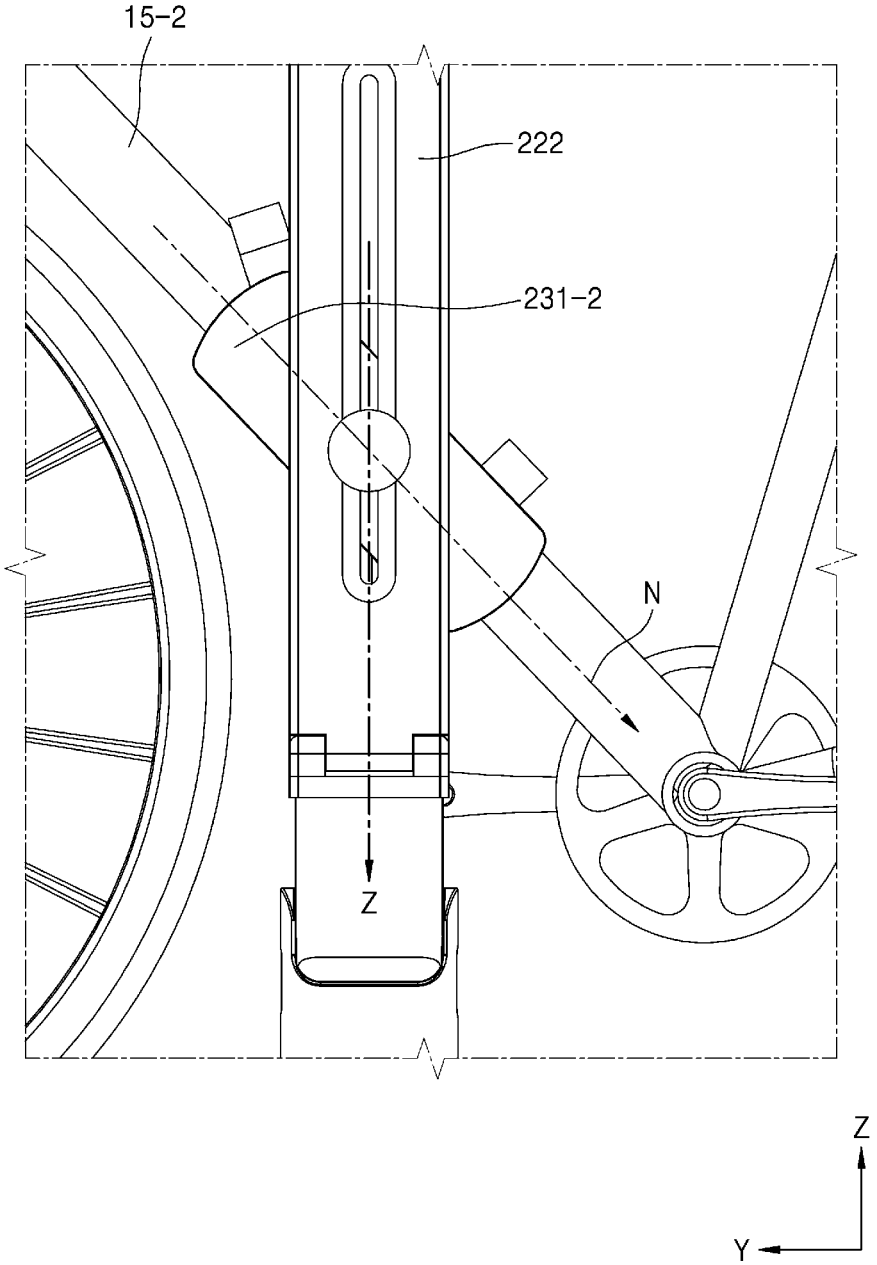
FIGS. 12A and 12B are perspective views illustrating a frame support, according to another embodiment of the present invention.
Figure 12B:
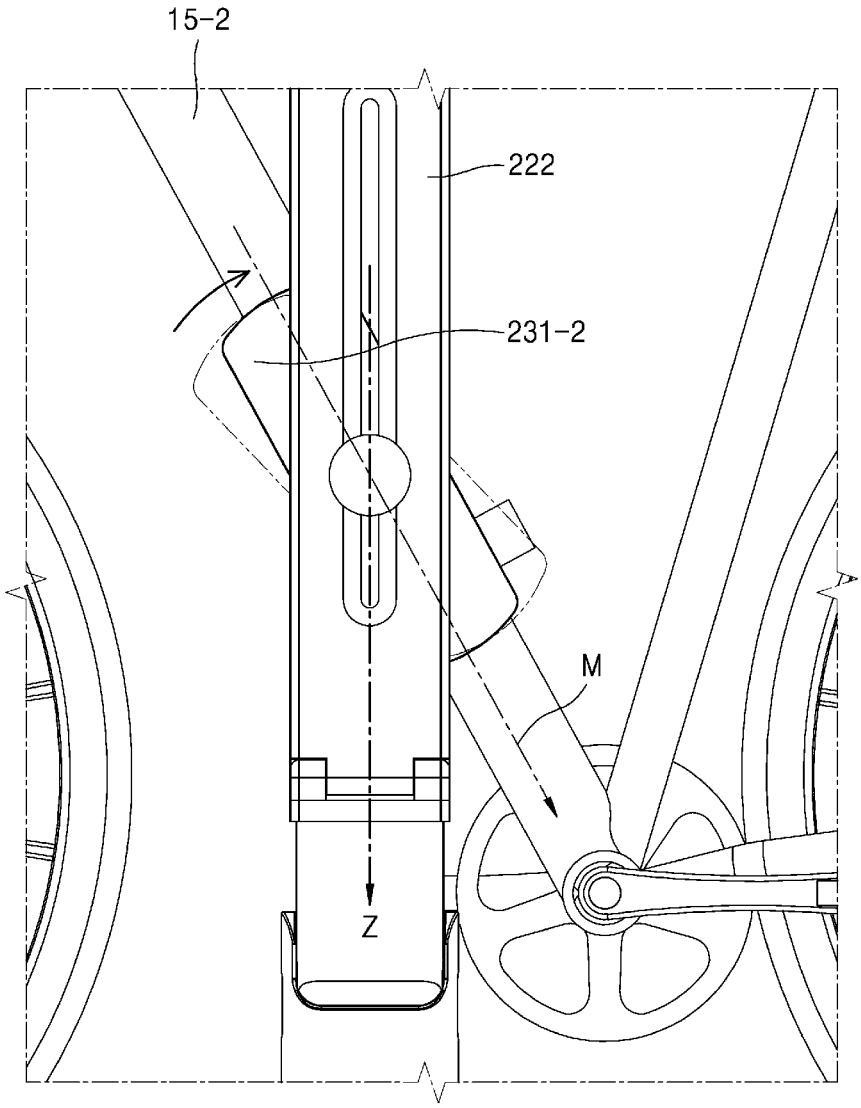

FIGS. 12A and 12B are perspective views illustrating a frame support, according to another embodiment of the present invention.

Referring to FIG. 12A, the third frame support 230 according to an embodiment may include the 2-1$^{th}$ fixing member 231-1 and the 2-2$^{th}$ fixing member 231-2 extending in the same direction as the lower frame 15-2 extending in the second direction N. Accordingly, a support area between the lower frame 15-2 and the 2-1$^{th}$ and 2-2$^{th}$ fixing members 231-1 and 231-2 may be maximized, and a support force between the lower frame 15-2 and the third frame support 230 may increase. However, an extension direction of the lower frame 15-2 may vary according to a model of a bicycle. For example, when the lower frame 15-2 extends in the third direction M different from the second direction N as shown in FIG. 12B, a support area between the third frame support 230 and the lower frame 15-2 illustrated in FIG. 12A may decrease.

Referring to FIG. 12B, the third frame support 230 according to an embodiment may be connected to rotate clockwise or counterclockwise about the rotation shafts 234-11 and 234-21 with respect to the second frame support 220, to be compatible with various lower frames 15-2. For example, when the lower frame 15-2 extends in the third direction M rotated by a certain angle clockwise compared to the second direction N, the third frame support 230, more particularly, the 2-1$^{th}$ fixing member 231-1 and the 2-2$^{th}$ fixing member 231-2, may rotate by a certain angle clockwise about the rotation shafts 234-11 and 234-21 with respect to the second frame support 220. In this case, for example, a rotation angle of each of the 2-1$^{th}$ fixing member 231-1 and the 2-2$^{th}$ fixing member 231-2 may be equal to or greater than 0° and equal to or less than 60°. Also, a rotation path of each of the 2-1$^{th}$ fixing member 231-1 and the 2-2$^{th}$ fixing member 231-2 may be set to gradually increase a rotation angle or to increase stepwise by a certain angle. When rotation is completed, the user may fix a relative position of the third frame support 230 to the second frame support 220 by using the fastener 223. As described above, as the third frame support 230 rotates in an extension direction of the lower frame 15-2, a support area between the lower frame 15-2 and the 2-1$^{th}$ and 2-2$^{th}$ fixing members 231-1 and 231-2 may be maintained, and a support force between the lower frame 15-2 and the third frame support 230 may also be maintained.

Figure 13:
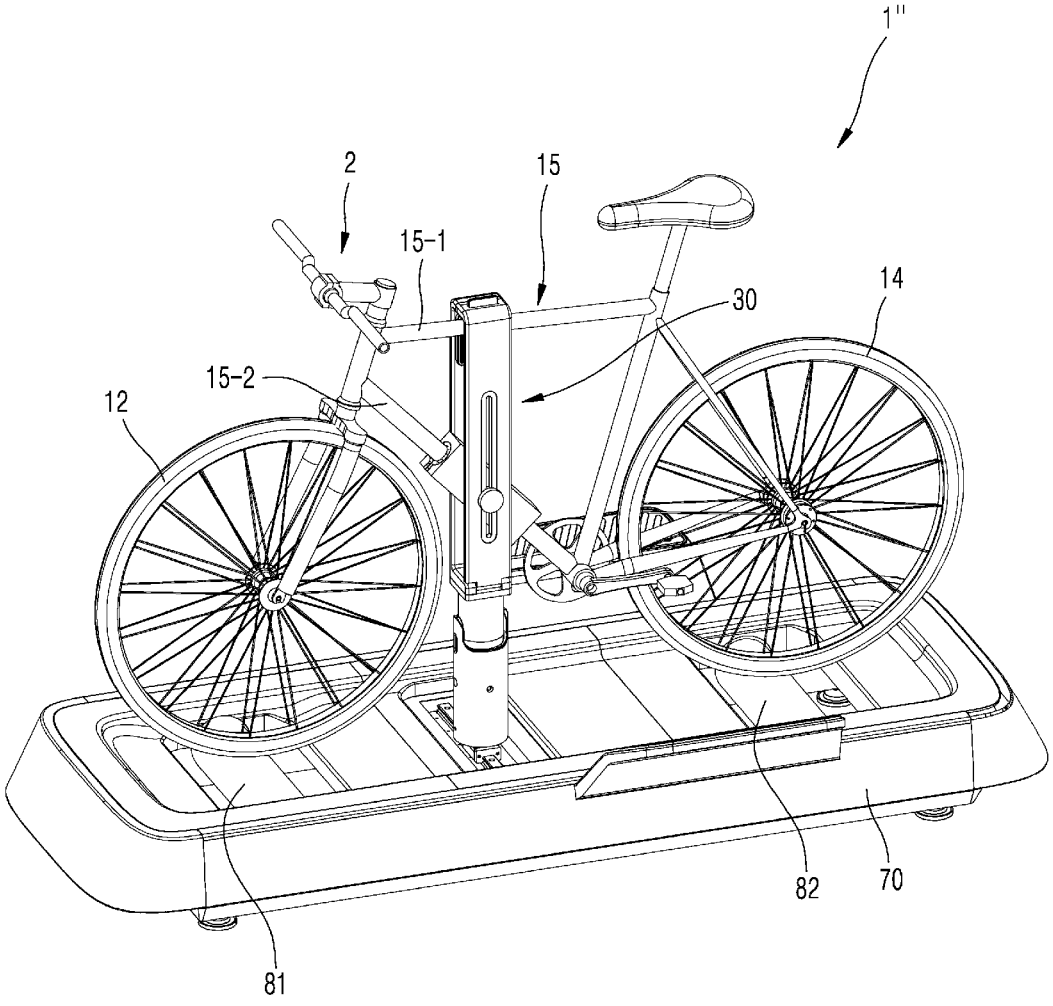
FIG. 13 is a perspective view illustrating a bicycle simulator, according to another embodiment of the present invention.
Figure 14:
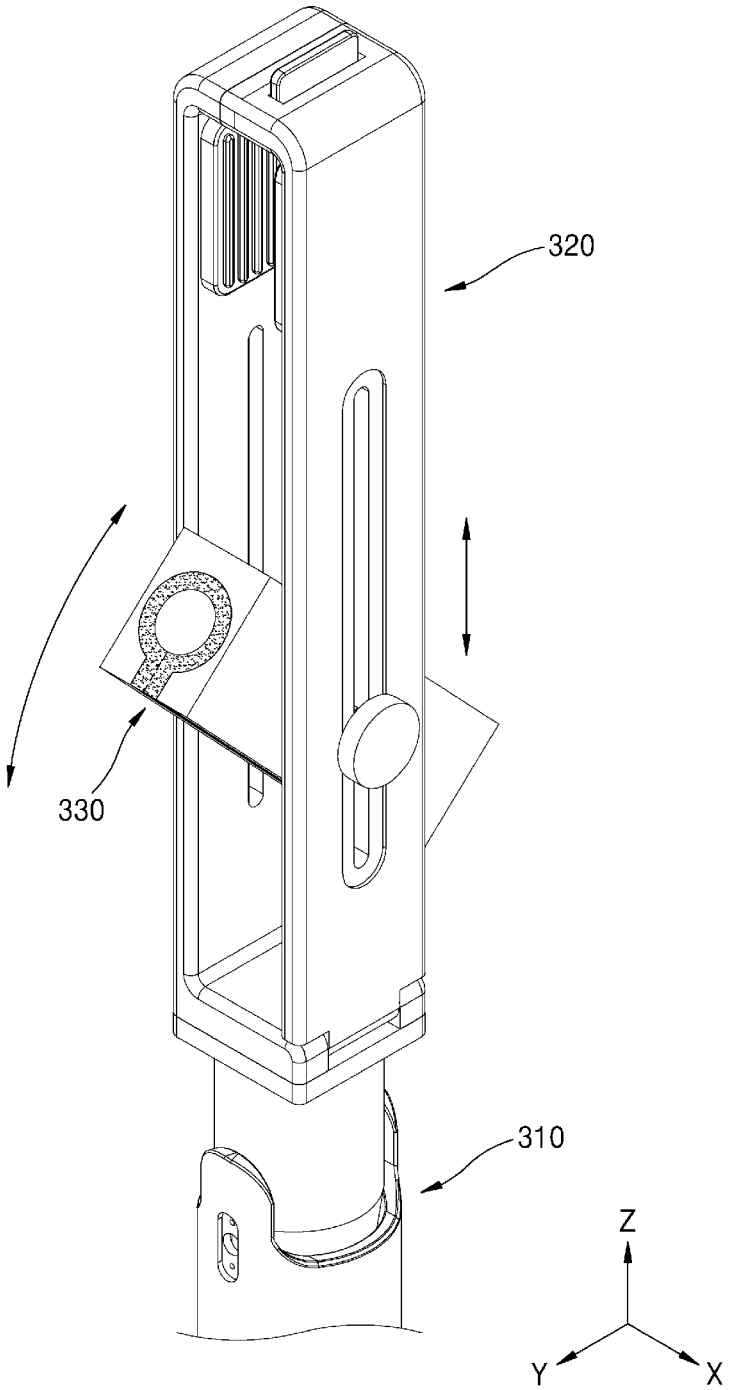
FIG. 14 is a perspective view illustrating a frame support, according to another embodiment of the present invention.
Figure 15:
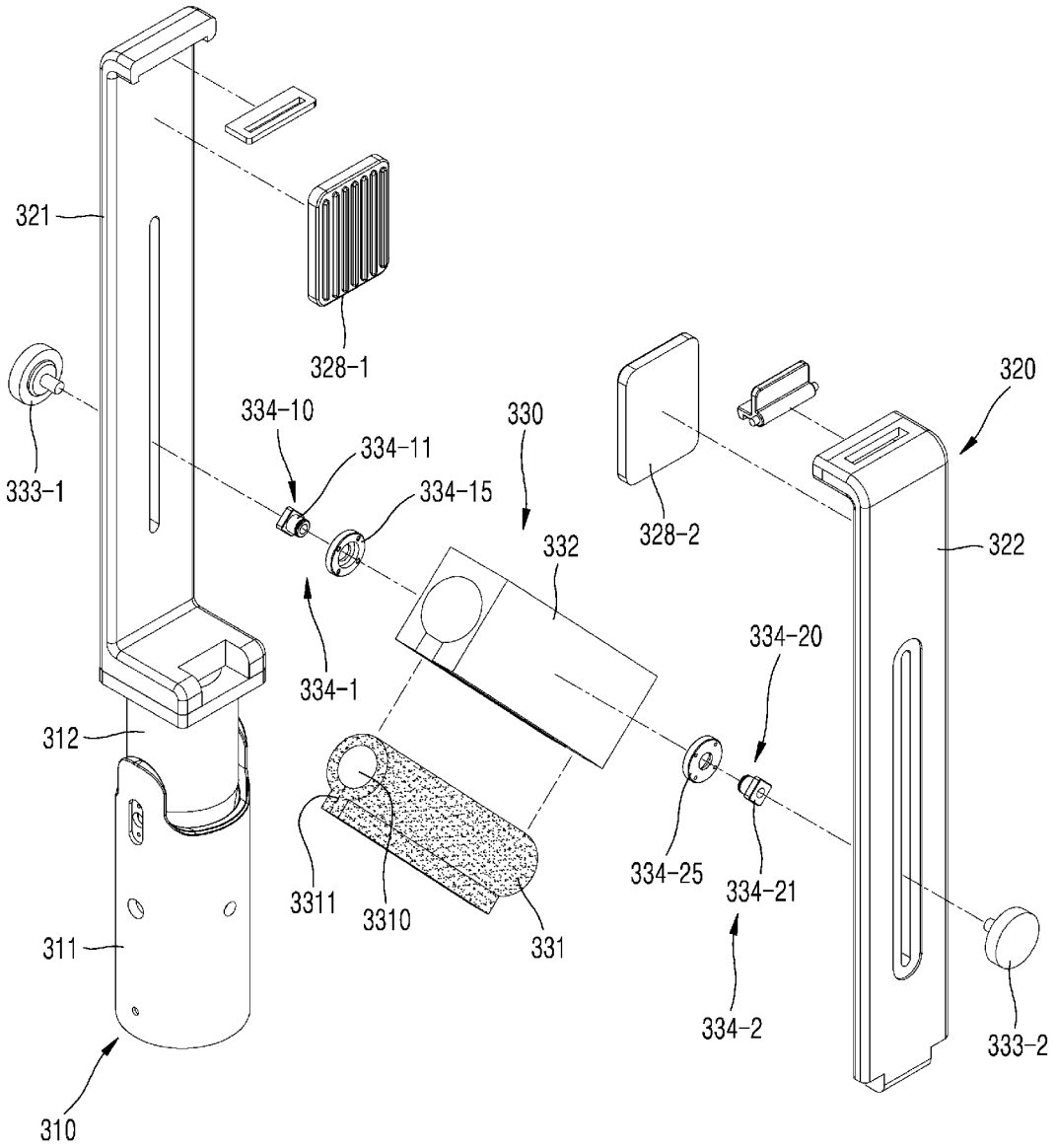
FIG. 15 is an exploded perspective view illustrating the frame support of FIG. 14.
Figure 16A:
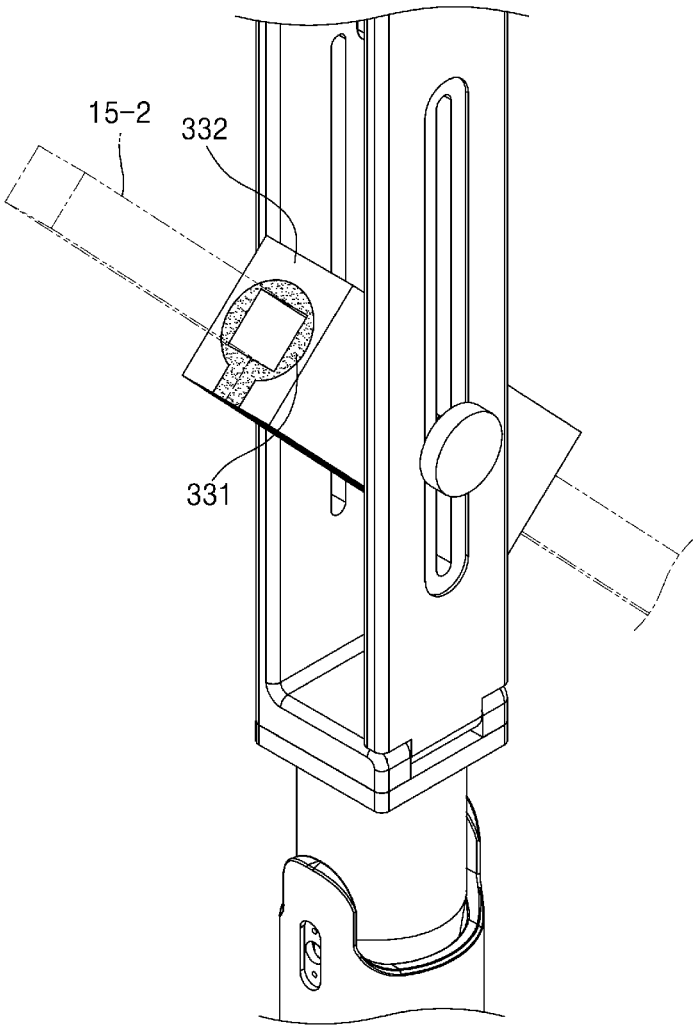
FIGS. 16A through 16C are partial perspective views illustrating a frame support, according to another embodiment of the present invention.
Figure 16B:
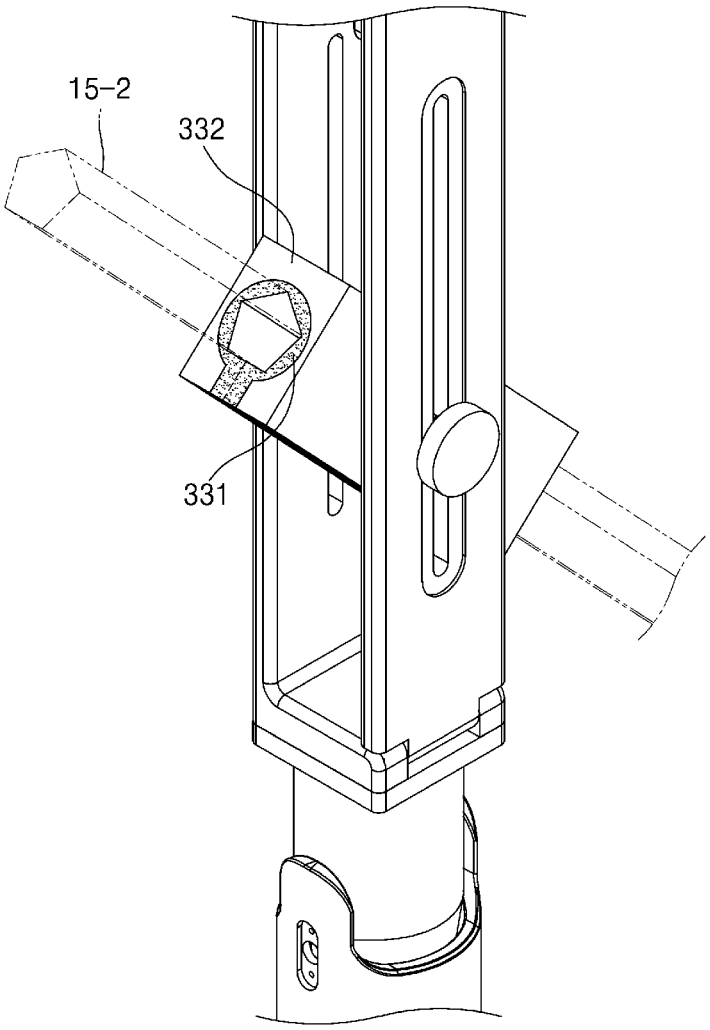
Figure 16C:
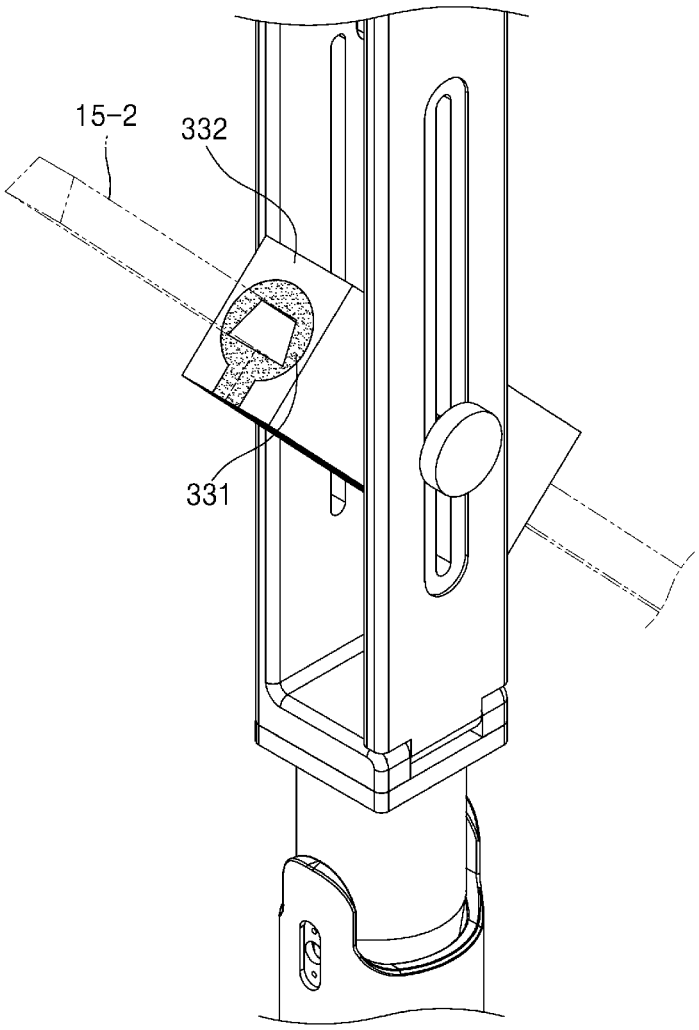

FIG. 13 is a perspective view illustrating a bicycle simulator, according to another embodiment of the present invention. FIG. 14 is a perspective view illustrating a frame support, according to another embodiment of the present invention. FIG. 15 is an exploded perspective view illustrating the frame support of FIG. 14. FIGS. 16A through 16C are partial perspective views illustrating a frame support, according to another embodiment of the present invention.

In the above embodiments, the deformation of the frame supports 10 and 20 corresponding to a change in an extension angle of the bicycle frame 15 has been described. Recently, the bicycle frame 15 has been designed to have various diameters and cross-sectional shapes as well as to change an extension angle according to consumers' needs. A frame support module 30 capable of supporting the bicycle frame 15 having any of various diameters and cross-sectional shapes will now be described.

Referring to FIGS. 13 through 15, a bicycle simulator 1" according to another embodiment of the present invention may include the frame support module 30, the base 70, the front wheel support 81, and the rear wheel support 82, to implement functions or actions as described above. The base 70, the front wheel support 81, and the rear wheel support 82 according to another embodiment of the present invention are substantially the same as those illustrated in FIGS. 1 through 2B, and thus for convenience of explanation, a repeated description will be omitted.

The frame support module 30 according to another embodiment of the present invention may include a first frame support 310, a second frame support 320, and a third frame support 330, as support members that are detachably coupled to the bicycle frame 15 and stably fix a position of the bicycle 2.

The first frame support 310 according to an embodiment is a support member supported on the base 70. For example, the first frame support 310 may include a first support bar 311, and a second support bar 312 coupled to rotate about one axis with respect to the first support bar 311. The second frame support 320 is a support member that supports the upper frame 15-1 and the lower frame 15-2 of a mounted bicycle. For example, the second frame support 320 may include a 1-1$^{th}$ fixing member 321 and a 1-2$^{th}$ fixing member 322 that support surfaces and other surfaces of the upper frame 15-1 and the lower frame 15-2, and a 1-1$^{th}$ soft pad 328-1 and a 1-2$^{th}$ soft pad 328-2. The first frame support 310 and the second frame support 320 according to another embodiment of the present invention are substantially the same as the first frame support 210 and the second frame support 220 of FIGS. 7 through 9, and thus for convenience of explanation, a repeated description will be omitted.

The third frame support 330 is a support member that supports the lower frame 15-2 of the mounted bicycle. For example, the third frame support 330 may include a soft support member 331 that is formed of a soft material and surrounds and supports the lower frame 15-2, a housing 332 in which the soft support member 331 is received, sliders 333-1 and 333-2 that guide a movement path of the housing 332 with respect to the second frame support 320, and the rotation couplers 334-1 and 334-2 that rotate the housing 332 with respect to the second frame support 320.

The soft support member 331 may include a seating portion 3310 in which the lower frame 15-2 may be located, and may include a soft material, for example, silicone or rubber, to surround the lower frame 15-2 having any of various shapes. For example, the seating portion 3310 may be formed as a through-hole extending in one direction, and a diameter of the seating portion 3310 may be less than a diameter of the lower frame 15-2. Because the soft support member 331 includes a soft material as described above, the lower frame 15-2 having a quadrangular, pentagonal, or trapezoidal cross-section as shown in FIGS. 16A through 16C may be supported by the soft support member 331. Also, the soft support member 331 according to an example may include a cut portion 3311 into which the lower frame 15-2 may be inserted. The cut portion 3311 is located to provide an inlet hole into which the lower frame 15-2 may be inserted, by cutting a part of the seating portion 3310. Accordingly, after the lower frame 15-2 is inserted into the seating portion 3310, the lower frame 15-2 may be supported by the soft support member 331 until the lower frame 15-2 is detached by the user.

The housing 332 is an accommodation member in which the soft support member 331 may be received. For example, the housing 332 may be provided in a rectangular parallelepiped shape with an open bottom surface corresponding to the cut portion 3311, and a front surface and a rear surface of the housing 332 may be opened so that the lower frame 15-2 is inserted into the seating portion 3310. Also, in an example, the housing 332 may be detachably located on bearings 334-15 and 334-25. Accordingly, the user may first support the lower frame 15-2 by using the soft support member 331 received in the housing 332, and may support the upper frame 15-1 and the lower frame 15-2 on the second frame support 320 by coupling the housing 332 to the rotation couplers 334-1 and 334-2. Accordingly, user convenience for mounting the bicycle 2 on the bicycle simulator 1" may be improved.

The sliders 333-1 and 333-2 are guide members that guide a movement path of the housing 332 in the first direction Z. The sliders 333-1 and 333-2 according to another embodiment of the present invention are substantially the same as the sliders 233-1 and 233-2 illustrated in FIGS. 7 through 9, and thus for convenience of explanation, a repeated description will be omitted.

The rotation couplers 334-1 and 334-2 are connection members that rotatably connect the housing 332 with respect to the second frame support 320. For example, the rotation couplers 334-1 and 334-2 may include intermediate couplers 334-10 and 334-20 having end portions into and on which the sliders 333-1 and 333-2 are inserted and supported, and the bearings 334-15 and 334-25 on which the intermediate couplers 334-10 and 334-20 are rotatably supported and that are detachably fixed to both side portions of the housing 332. For example, the intermediate couplers 334-10 and 334-20 may be inserted into the bearings 334-15 and 334-25, and may include rotation shafts 334-11 and 334-21 into which the sliders 333-1 and 333-2 are inserted. In this case, the housing 332 supported on the bearings 334-15 and 334-25 may rotate about the rotation shafts 334-11 and 334-21. Accordingly, the soft support member 331 received in the housing 332 may vertically move in the first direction Z with respect to the second frame support 320 according to a shape of the lower frame 15-2 that is a support target as shown in FIG. 14, and may also rotate about the rotation shafts 334-11 and 334-21, thereby increasing a support area for the lower frame 15-2.

Figure 17:
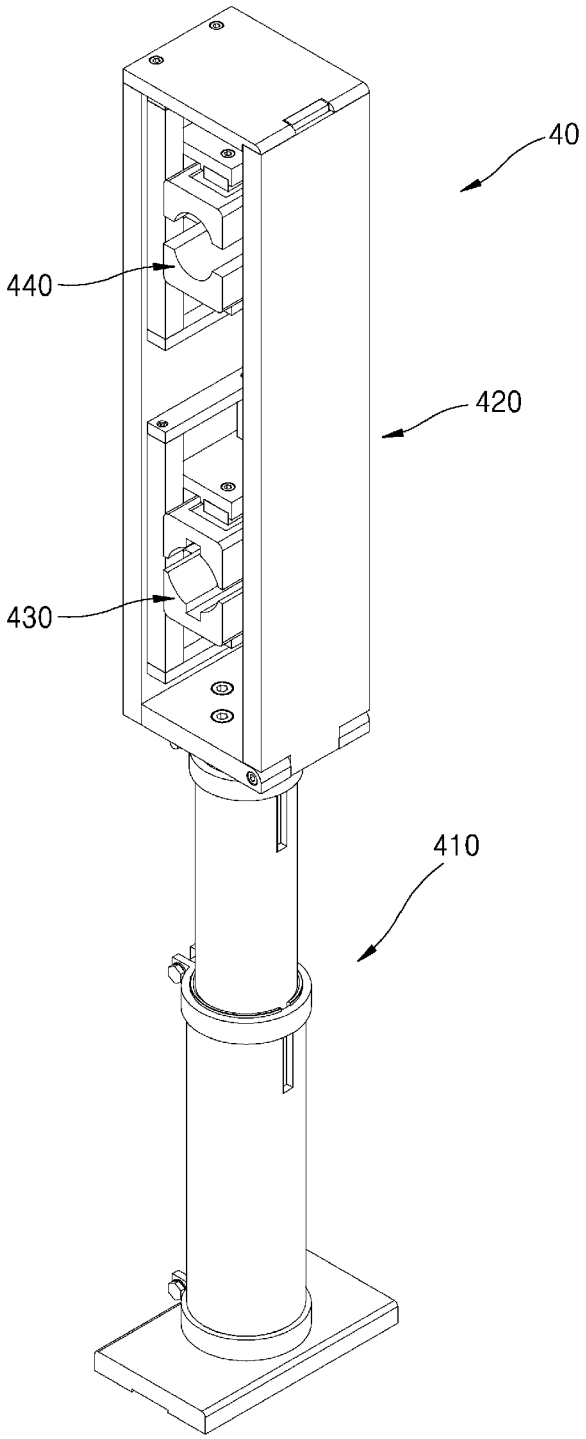
FIG. 17 is a perspective view illustrating a frame support, according to another embodiment of the present invention.
Figure 18:
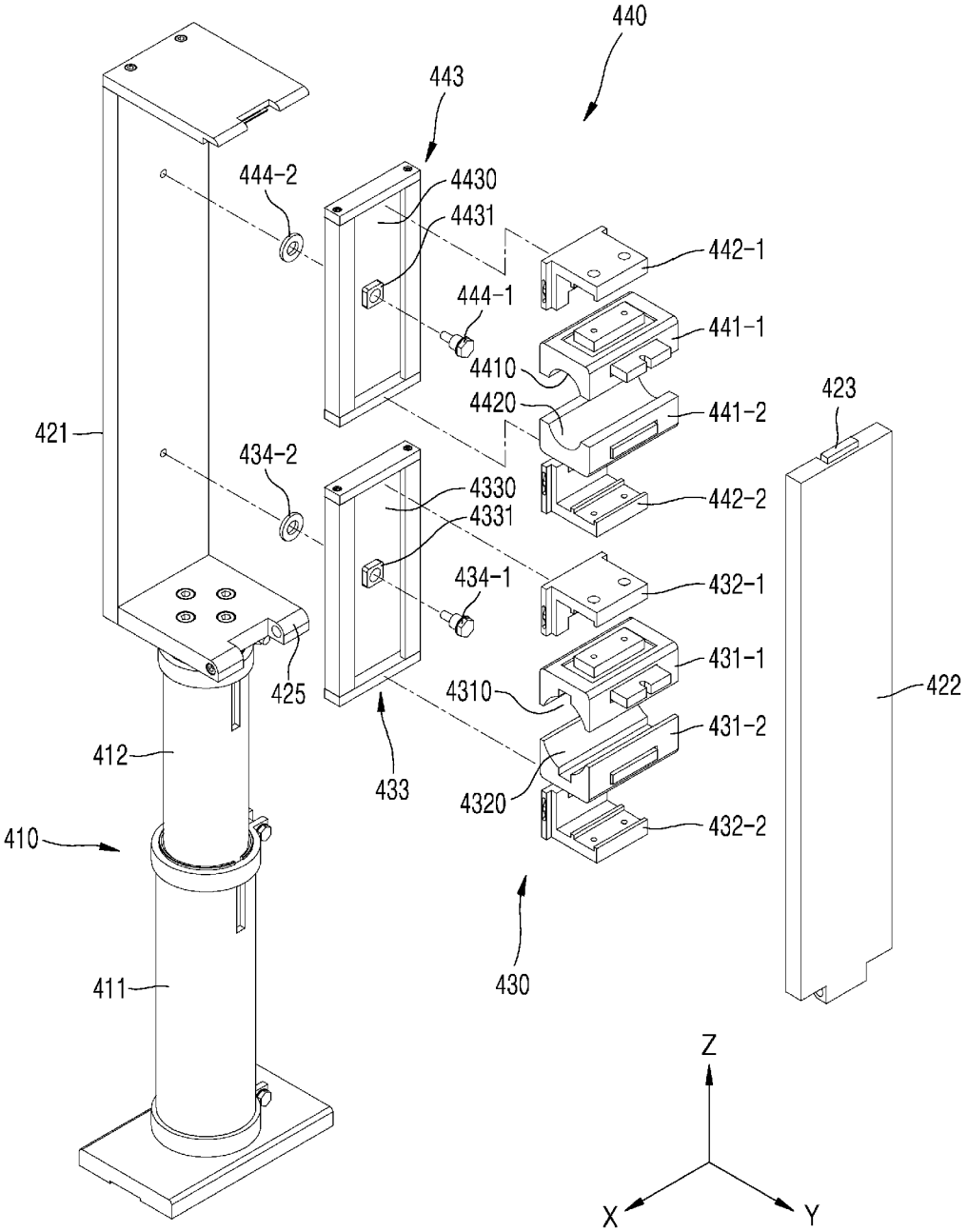
FIG. 18 is an exploded perspective view illustrating the frame support of FIG. 17.
Figure 19:
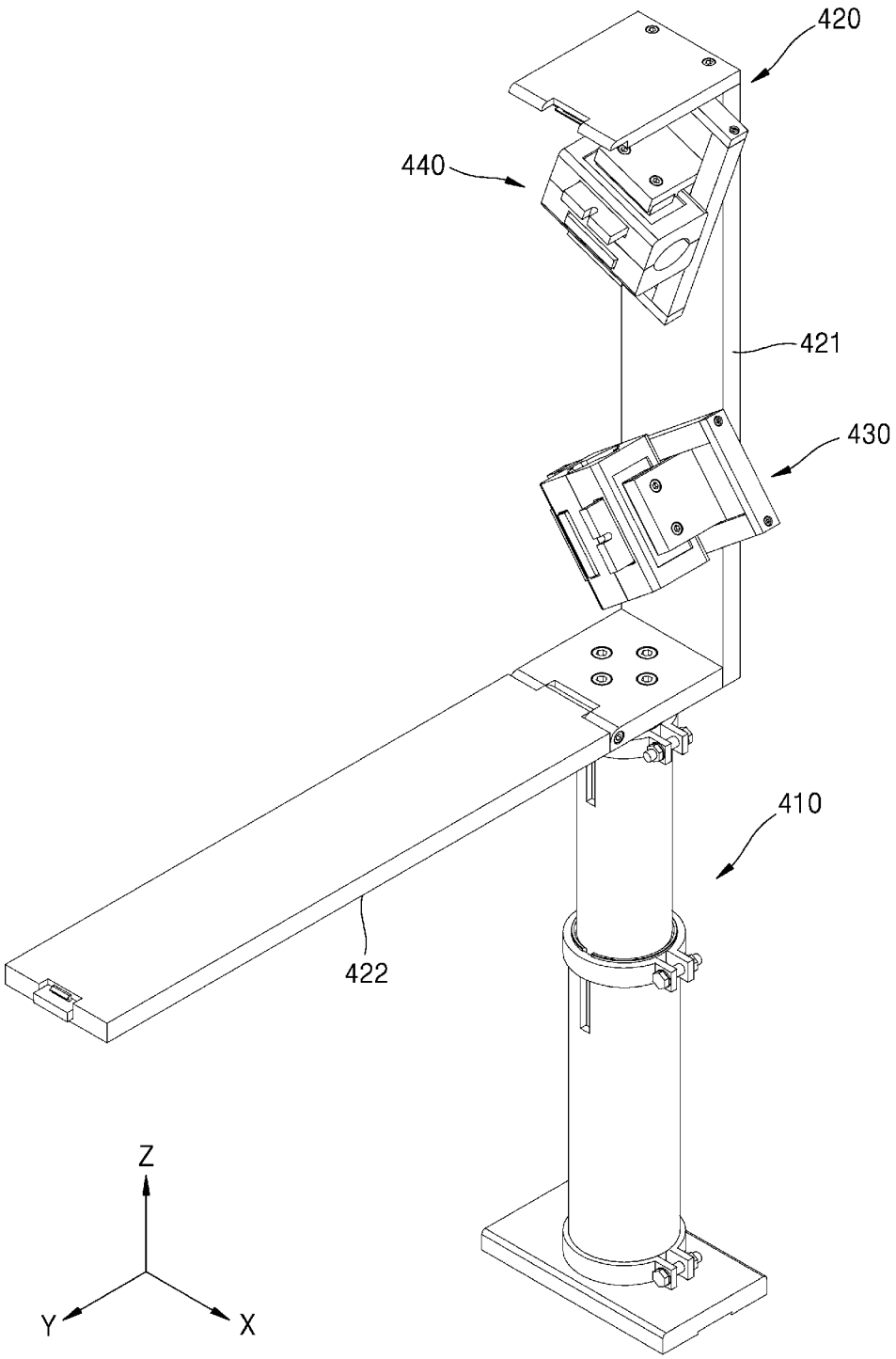
FIG. 19 is a perspective view illustrating a frame support, according to another embodiment of the present invention.
Figure 20:
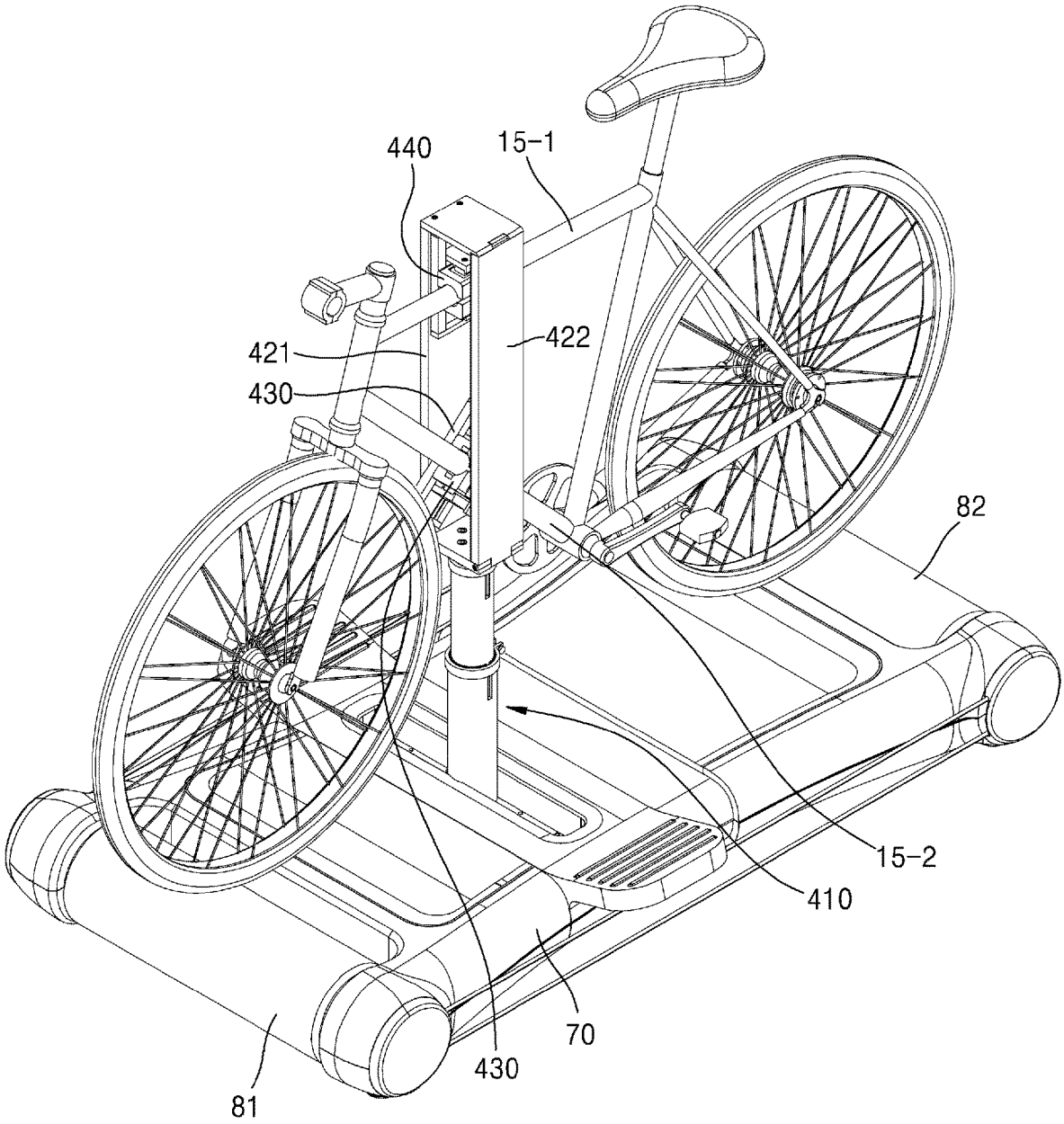
FIG. 20 is a perspective view illustrating a frame support, according to another embodiment of the present invention.

FIG. 17 is a perspective view illustrating a frame support, according to another embodiment of the present invention. FIG. 18 is an exploded perspective view illustrating the frame support of FIG. 17. FIG. 19 is a perspective view illustrating a frame support, according to another embodiment of the present invention. FIG. 20 is a perspective view illustrating a frame support, according to another embodiment of the present invention.

In the above embodiments, the frame supports 10 and 20 according to a change in an extension angle of the bicycle frame 15 and the frame support module 30 corresponding to a cross-sectional shape of the bicycle frame 15 have been described. Recently, the bicycle frame 15 has been designed to have various diameters and cross-sectional shapes as well as to change an extension angle according to consumers' needs. A frame support module 40 capable of supporting the bicycle frame 15 having any of various extension angles and various diameters and cross-sectional shapes will now be described.

The frame support module 40 according to another embodiment of the present invention may include a first frame support 410, a second frame support 420, a third frame support 430, and a fourth frame support 440, as support members that are detachably coupled to the bicycle frame 15 and stably fix a position of the bicycle 2.

The first frame support 410 according to an embodiment is a support member extending in the first direction Z and having one end portion supported on the base 70. For example, the first frame support 410 may include a first support bar 411, and a second support bar 412 coupled to rotate about one axis with respect to the first support bar 411.

The second frame support 420 may extend in the first direction, and may be supported on an end portion of the first frame support 410. The second frame support 420 according to an example may support the third frame support 430 and the fourth frame support 440. For example, the second frame support 420 may include a 1-1$^{th}$ fixing member 421 extending in one direction and a 1-2$^{th}$ fixing member 422 facing the 1-1$^{th}$ fixing member 421.

The 1-1$^{th}$ fixing member 421 may be a flat member extending in the first direction Z in which the first frame support 410 extends, to support surfaces of the third frame support 430 and the fourth frame support 440. For example, the 1-1$^{th}$ fixing member 421 may include a rigid member for supporting the third frame support 430 and the fourth frame support 440, for example, a reinforced plastic or metal material.

The 1-2$^{th}$ fixing member 422 may be a flat member facing the 1-1$^{th}$ fixing member 421, to support other surfaces of the third frame support 430 and the fourth frame support 440. For example, the 1-2$^{th}$ fixing member 422 may extend in the first direction Z, like the 1-1$^{th}$ fixing member 421. For example, the 1-2$^{th}$ fixing member 422 may also include a rigid member for supporting the third frame support 430 and the fourth frame support 440, for example, a reinforced plastic or metal material.

According to an example, a hinge portion 425 may be located on end portions of the 1-1$^{th}$ fixing member 421 and the 1-2$^{th}$ fixing member 422, so that the 1-2$^{th}$ fixing member 422 rotates about one axis X with respect to the 1-1$^{th}$ fixing member 421. For example, when the upper frame 15-1 and the lower frame 15-2 are located between the 1-1$^{th}$ fixing member 421 and the 1-2$^{th}$ fixing member 422, as shown in FIG. 19, the 1-2$^{th}$ fixing member 422 may be opened by rotating clockwise about one axis X with respect to the 1-1$^{th}$ fixing member 421. Accordingly, the user may locate the upper frame 15-1 and the lower frame 15-2 between the 1-1$^{th}$ fixing member 421 and the 1-2$^{th}$ fixing member 422. When arrangement of the upper frame 15-1 and the lower frame 15-2 between the 1-1$^{th}$ fixing member 421 and the 1-2$^{th}$ fixing member 422 is completed, as shown in FIG. 20, the 1-2$^{th}$ fixing member 422 may be closed by rotating counterclockwise about one axis X so that other end portions of the 1-1$^{th}$ fixing member 421 and the 1-2$^{th}$ fixing member 422 contact each other. In this case, the other end portions of the 1-1$^{th}$ fixing member 421 and the 1-2$^{th}$ fixing member 422 may be fastened to each other by using a fastener 423 located on the other end portions of the 1-1$^{th}$ fixing member 421 and the 1-2$^{th}$ fixing member 422. Accordingly, relative positions of the 1-1$^{th}$ fixing member 421 and the 1-2$^{th}$ fixing member 422 may be fixed, and the upper frame 15-1 and the lower frame 15-2 may be supported between the 1-1$^{th}$ fixing member 421 and the 1-2$^{th}$ fixing member 422.

The third frame support 430 is a support member that supports the lower frame 15-2 of a mounted bicycle. For example, the third frame support 430 may include first and second soft support members 431-1 and 431-2 that are formed of a soft material and surround and support the lower frame 15-2, first and second support cases 432-1 and 432-2 on which the first and second soft support members 431-1 and 431-2 are supported, a first slide guide 433 that guides movement paths of the first and second support cases 432-1 and 432-2, and rotation couplers 434-1 and 434-2 that rotate the first slide guide 433 with respect to the second frame support 420.

The first soft support member 431-1 may include a first seating portion 4310 in which a part of the lower frame 15-2 may be mounted. In this case, the second soft support member 432-1 may include a second seating portion 4320 in which the remaining part of the lower frame 15-2 may be mounted. For example, the first seating portion 4310 and the second seating portion 4320 may have semicircular cross-sections, and the lower frame 15-2 may be supported when the first seating portion 4310 and the second seating portion 4320 are coupled to each other. However, the present disclosure is not limited thereto, and shapes of the first seating portion 4310 and the second seating portion 4320 may vary according to a shape of the lower frame 15-2. Accordingly, according to an embodiment, the lower frame 15-2 may be supported when the first soft support member 431-1 and the second soft support member 432-1 are coupled to each other. Also, in an example, the first and second soft support members 431-1 and 431-2 may include a soft material, for example, silicone or rubber, to surround the lower frame 15-2 having any of various shapes.

The first support case 432-1 is a support member that may support the first soft support member 431-1. For example, the first support case 432-1 may be fixed to the first soft support member 431-1. Also, the first soft support member 431-1 may be coupled to the first slide guide 433 to be movable in the Z-axis direction. The second support case 432-2 is a support member that may support the second soft support member 431-2. For example, the second support case 432-2 may be fixed to the second soft support member 431-2. Also, the second soft support member 431-2 may be coupled to the first slide guide 433 to be movable in the Z axis direction. As described above, the first soft support member 431-1 and the second soft support member 431-2 respectively fixed to the first support case 432-1 and the second support case 432-2 may move away from each other or closer to each other along the first slide guide 433. Accordingly, the lower frame 15-2 having any of various diameters may be inserted between the first soft support member 431-1 and the second soft support member 431-2 by adjusting an interval between the first soft support member 431-1 and the second soft support member 431-2, and the lower frame 15-2 having any of various diameters may be supported by adjusting an interval between the first soft support member 431-1 and the second soft support member 431-2.

The first rotation coupler 434-1 is a connection member that rotatably connects the third frame support 430 with respect to the second frame support 420. For example, the first rotation coupler 434-1 may be a rotation shaft fixed to the second frame support 420. For example, the first rotation coupler 434-1 may be a rotation shaft extending in one direction (Y-axis direction). An end portion of the first rotation coupler 434-1 may be fixed to the second frame support 420, and the other end portion of the first rotation coupler 434-1 may be rotatably located on the first slide guide 433. In this case, the first rotation coupler 434-1 may pass through a through hole 4331 formed in the first slide guide 433, and the bearing 434-2.

As described above, as the first slide guide 433 rotates about the first rotation coupler 434-1, the first soft support member 431-1 and the second soft support member 431-2 fastened to the first slide guide 433 by the first support case 432-1 and the second support case 432-2 may also rotate about the first rotation coupler 434-1. Accordingly, the user may rotate the first soft support member 431-1 and the second soft support member 431-2 according to a shape of the lower frame 15-2 extending at any of various angles.

The fourth frame support 440 is a support member that is spaced apart by a certain interval from the third frame support 430 in the first direction Z and supports the upper frame 15-1 of the mounted bicycle. For example, the fourth frame support 440 may include third and fourth soft support member 441-1 and 441-2 that respectively include a third seating portion 4410 and a fourth seating portion 4420, are formed of a soft material, and surround and support the upper frame 15-1, third and fourth support cases 442-1 and 442-2 on which the third and fourth soft support members 441-1 and 441-2 are supported, a second slide guide 443 that guides movement paths of the third and fourth support cases 442-1 and 442-2, and a second rotation coupler 444-1 that rotates the second slide guide 443 with respect to the second frame support 420.

The third and fourth soft support members 441-1 and 441-2, the third and fourth support cases 442-1 and 442-2, the second slide guide 443, and the second rotation coupler 444-1 included in the fourth frame support 440 are substantially the same as the first and second soft support members 431-1 and 431-2, the first and second support cases 432-1 and 432-2, the first slide guide 433, and the first rotation coupler 434-1 included in the third frame support 430, and thus a repeated description will be omitted.

As described above, sizes and angles of supports included in the third frame support 430 and the fourth frame support 440 may vary according to the upper frame 15-1 and the lower frame 15-2 extending in various sizes and at various angles. Accordingly, because bicycles of various models may be supported by the frame support module 40 according to an example, user convenience may be improved.

Figure 21A:
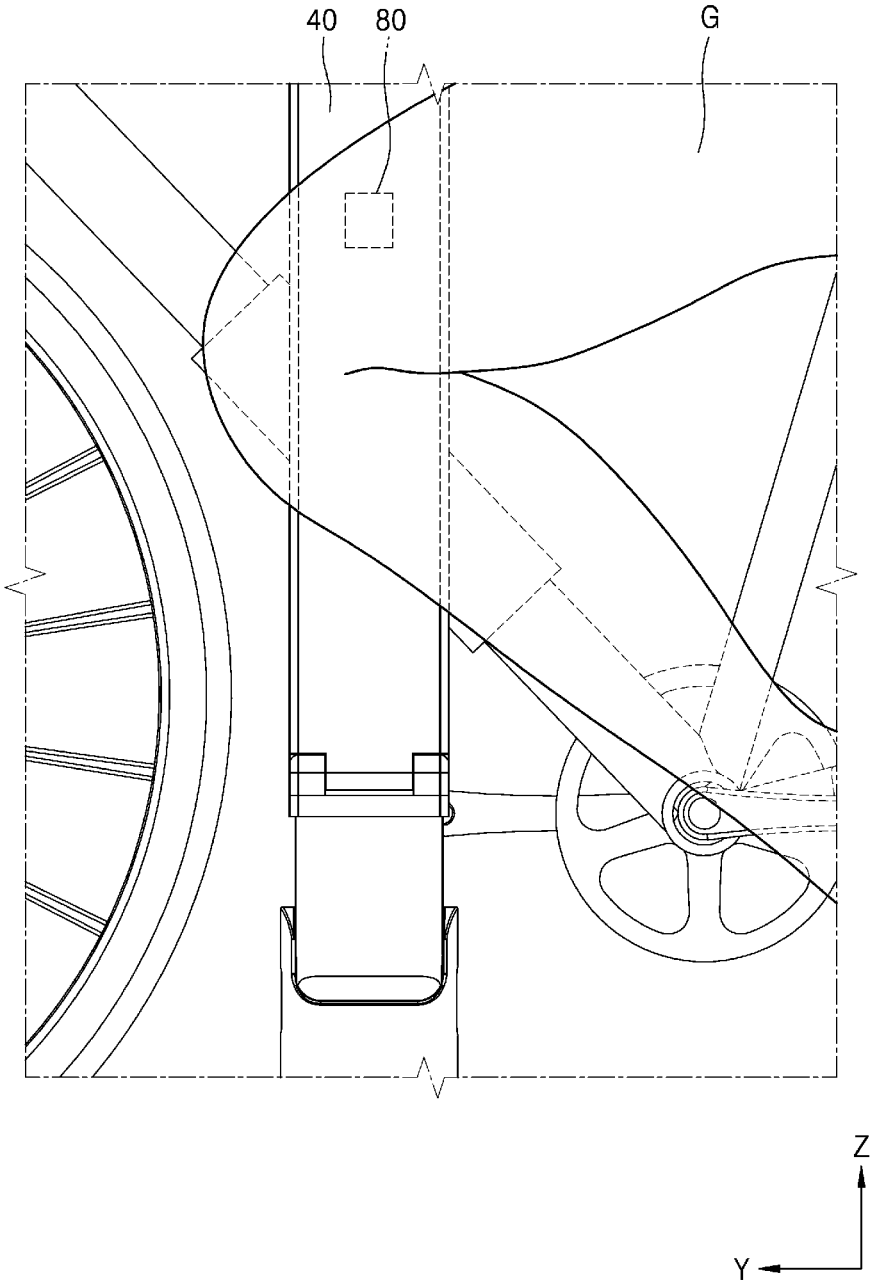
FIGS. 21A and 21B are side views illustrating a frame support, according to another embodiment of the present invention.
Figure 21B:
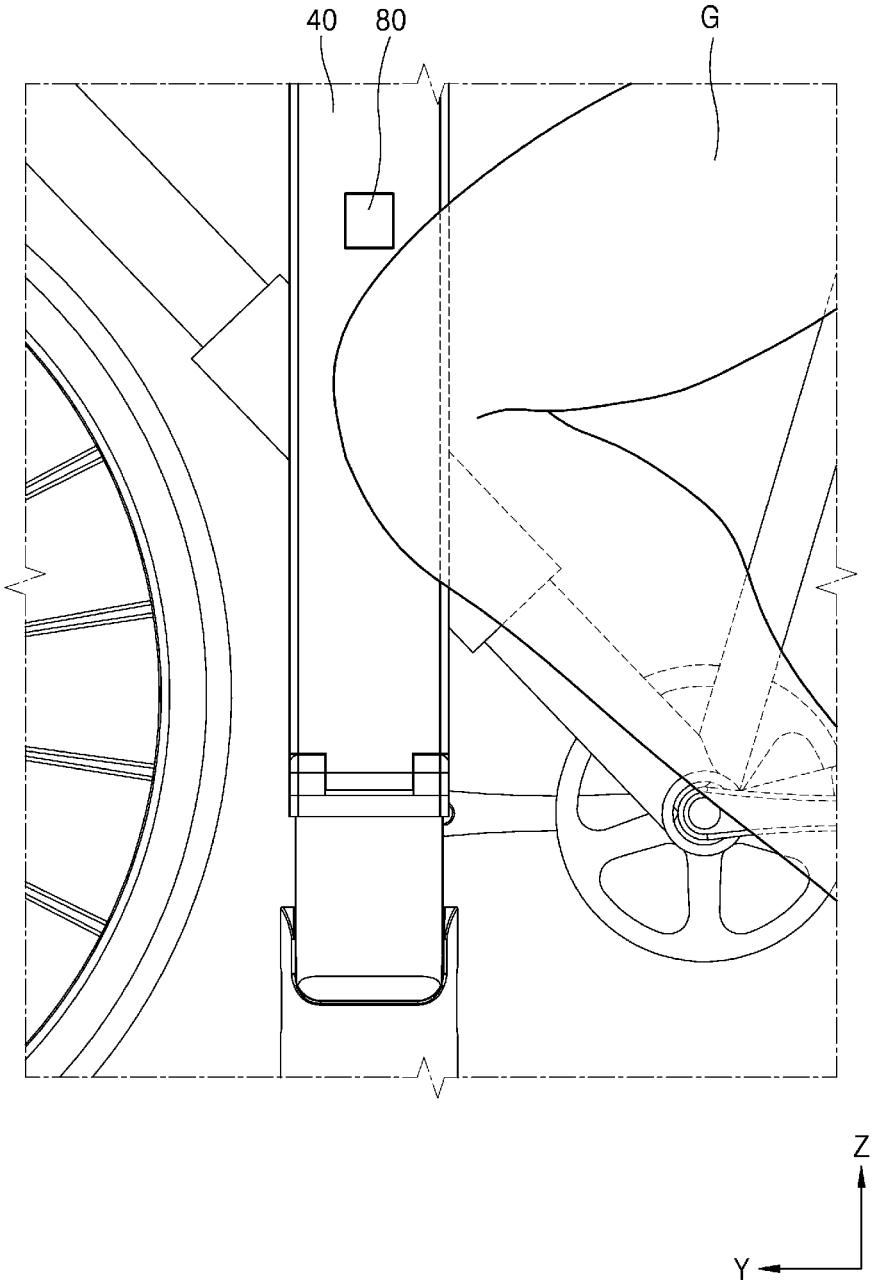

FIGS. 21A and 21B are side views illustrating a frame support, according to another embodiment of the present invention.

A cadence measuring device 80 capable of measuring a rotational speed of a user's leg G may be located on the frame support module 40 according to another embodiment of the present invention. For example, cadence is a rate at which a user turns pedals per minute. According to an example, the cadence measuring device 80 may include a sensor capable of detecting whether the cadence measuring device 80 and the user's leg G face each other, for example, an optical encoder or a magnetic encoder. However, the present disclosure is not limited thereto, and the cadence measuring device 80 may include any sensor capable of detecting whether the cadence measuring device 80 and the user's leg G face each other. Also, according to an example, the cadence measuring device 80 may be located on a side portion of the frame support module 40 facing the user's leg G. For example, the cadence measuring device 80 may be located on an outer surface of the second frame support 420.

For example, while the user pedals a bicycle once, as shown in FIG. 21A, the cadence measuring device 80 may face the user's leg G. Also, as shown in FIG. 22A, the cadence measuring device 80 may not face the user's leg G. As described above, a rotational speed of the user's leg G may be measured by measuring an interval between a time when the cadence measurement deice 80 faces the user's leg G and a time when the cadence measuring device 80 does not face the user's leg G as shown in FIGS. 21A and 21B.

As described above, because the cadence measuring device 80 is located on the frame support module 40, there is no need to locate a separate cadence measuring device on each bicycle. Accordingly, user convenience may be improved and costs for attaching individual sensors may be reduced.

In the above, although specific embodiments of the present invention have been described and illustrated, it will be obvious to one of ordinary skill in the art that the present invention is not limited to the described embodiments, and that various modifications and variations may be made without departing from the spirit and scope of the present invention. Accordingly, such modifications or variations should not be individually understood from the technical spirit or viewpoint of the present invention, and the modified embodiments should be said to belong to the claims of the present invention.

The invention claimed is:

1. A frame support module comprising:

a first frame support extending in a first direction;

a second frame support extending in the first direction and supported on an end portion of the first frame support, wherein the second frame support further comprises a pair of flat members facing each other and extending in the first direction such that the second frame support forms a housing;

a third frame support located in the housing and connected to an inner surface of the pair of flat members to be rotatable at a first angle about a first axis with respect to the second frame support; and a fourth frame support located in the housing and spaced apart from the third frame support in the first direction by a predetermined interval such that an upper frame of a mounted bicycle is accommodated in the fourth frame support, wherein the fourth frame support is connected to the inner surface of the pair of flat members to be rotatable at a second angle about a second axis with respect to the second frame support.

2. The frame support module of claim 1, wherein the pair of flat members of the second frame support further comprises:

a first fixing member extending in the first direction, wherein a first slide guide is rotatably coupled to the first fixing member rotatably fixes-by a first rotation coupler and a second slide guide is rotatably coupled to the first fixing member by a second rotation coupler, and surfaces of the third frame support and the fourth frame support are fastened to the first slide guide and the second slide guide, respectively; and a second fixing member extending in the first direction, facing the first fixing member.

3. The frame support module of claim 2, wherein the second fixing member of the second frame support is configured to be rotatably coupled to the first fixing member with respect to the first fixing member.

4. The frame support module of claim 1, wherein the third frame support comprises:

a first soft support member comprising a first seating portion; and a second soft support member coupled to the first soft support member to form a space that receives a lower frame of the mounted bicycle, the second soft support member comprising a second seating portion.

5. The frame support module of claim 4, further comprising:

a first support case fixed to the first soft support member and that supports the first soft support member;

a second support case fixed to the second soft support member and that supports the second soft support member; and a first slide guide coupled to the first soft support member and the second soft support member , wherein the first soft support member and the second soft support member move away from each other or move closer to each other along the first slide guide.

6. The frame support module of claim 5, further comprising a first rotation coupler having one end portion fixed to the second frame support and another end portion rotatably connected to the first slide guide, wherein the first slide guide rotates about the first rotation coupler with respect to the second frame support.

7. The frame support module of claim 1, wherein the fourth frame support comprises:

a third soft support member comprising a third seating portion; and a fourth soft support member coupled to the third soft support member to form a space that receives an upper frame of the mounted bicycle, the fourth soft support member comprising a fourth seating portion.

8. The frame support module of claim 7, further comprising:

a third support case fixed to the third soft support member and that supports the third soft support member;

a fourth support case fixed to the fourth soft support member and that supports the fourth soft support member; and a second slide guide coupled to the third soft support member and the fourth soft support member, wherein the third soft support member and the fourth soft support member move away from each other or move closer to each other along the second slide guide.

9. The frame support module of claim 8, further comprising a second rotation coupler having an end portion fixed to the second frame support and another end portion rotatably connected to the second slide guide, wherein the second slide guide rotates about the second rotation coupler with respect to the second frame support.

10. A bicycle simulator comprising:

a base;

a first frame support extending in a first direction and supported on the base;

a second frame support extending in the first direction and supported on an end portion of the first frame support, wherein the second frame support further comprises a pair of flat members facing each other and extending in the first direction such that the second frame support forms a housing;

a third frame support located in the housing and connected to an inner surface of the pair of flat members to be rotatable at a first angle about a first axis with respect to the second frame support; and a fourth frame support located in the housing and spaced apart from the third frame support in the first direction by a predetermined interval such that an upper frame of a mounted bicycle is accommodated in the fourth frame support, wherein the fourth frame support is connected to the inner surface of the pair of flat members to be rotatable at a second angle about a second axis with respect to the second frame support, wherein the third frame support supports a lower frame of a mounted bicycle which connects a front wheel and a rear wheel of the mounted bicycle, and the fourth frame support supports the upper frame of the mounted bicycle which connects the front wheel and the rear wheel of the mounted bicycle.

11. The bicycle simulator of claim 10, wherein the pair of flat members of the second frame support further comprises:

a first fixing member extending in the first direction, wherein a first slide guide is rotatably coupled to the first fixing member by a first rotation coupler and a second slide guide is rotatably coupled to the first fixing member by a second rotation coupler, and surfaces of the third frame support and the fourth frame support are fastened to the first slide guide and the second slide guide, respectively; and a second fixing member extending in the first direction, facing the first fixing member.

12. The bicycle simulator of claim 11, wherein the third frame support comprises:

a first soft support member comprising a first seating portion; and a second soft support member coupled to the first soft support member to form a space that receives a lower frame of the mounted bicycle, the second soft support member comprising a second seating portion, wherein a lower frame of the mounted bicycle is mounted on the first seating portion and the second seating portion.

13. The bicycle simulator of claim 12, further comprising:

a first support case fixed to the first soft support member and that supports the first soft support member;

a second support case fixed to the second soft support member and that supports the second soft support member; and a first slide guide coupled to the first soft support member and the second soft support member, wherein the first soft support member and the second soft support member move away from each other or move closer to each other along the first slide guide.

14. The bicycle simulator of claim 10, wherein the fourth frame support comprises:

a third soft support member comprising a third seating portion; and a fourth soft support member located to be coupled to the third soft support member to form a space that receives an upper frame of the mounted bicycle, the fourth soft support member comprising a fourth seating portion.

15. The bicycle simulator of claim 14, further comprising:

a third support case fixed to the third soft support member and that supports the third soft support member;

a fourth support case fixed to the fourth soft support member and that supports the fourth soft support member; and a second slide guide coupled to the third soft support member and the fourth soft support member, wherein the third soft support member and the fourth soft support member move away from each other or move closer to each other along the second slide guide.

* * * * *